US008540397B2

(12) United States Patent
Gill

(10) Patent No.: US 8,540,397 B2
(45) Date of Patent: Sep. 24, 2013

(54) LIGHTING APPARATUS USING LIGHT EMITTING DIODE

(75) Inventor: Jason Jae Gill, Omaha, NE (US)

(73) Assignee: Amoluxe Co. Ltd., Gyeonggi-do (KR)

( * ) Notice: Subject to any disclaimer, the term of this patent is extended or adjusted under 35 U.S.C. 154(b) by 223 days.

(21) Appl. No.: 12/863,001

(22) PCT Filed: Mar. 21, 2008

(86) PCT No.: PCT/KR2008/001595

§ 371 (c)(1),
(2), (4) Date: Jul. 15, 2010

(87) PCT Pub. No.: WO2009/091100

PCT Pub. Date: Jul. 23, 2009

(65) Prior Publication Data

US 2011/0051420 A1 Mar. 3, 2011

(30) Foreign Application Priority Data

Jan. 15, 2008 (KR) ..... 10-2008-0004242
Mar. 12, 2008 (KR) ..... 10-2008-0022969

(51) Int. Cl.
*F21S 4/00* (2006.01)
*F21V 21/00* (2006.01)

(52) U.S. Cl.
USPC . 362/249.03; 362/147; 362/187; 362/249.02; 362/612; 362/555; 362/800

(58) Field of Classification Search
USPC 362/147, 249.02–249.04, 243, 311.01–311.02, 362/184, 187, 547, 611–613, 555, 800
See application file for complete search history.

(56) References Cited

U.S. PATENT DOCUMENTS 5,000,569 A * 3/1991 Nylund ..... 356/237.1
5,268,828 A * 12/1993 Miura ..... 362/249.06

(Continued)

FOREIGN PATENT DOCUMENTS

CN 2851836 Y 12/2006
DE 10 2005 059 198 A1 6/2007

(Continued)

OTHER PUBLICATIONS

New Zealand Intellectual Property Office Examination Report: dated Sep. 20, 2011, Patent Applicaion No. 586949.

(Continued)

*Primary Examiner* — Anne Hines
*Assistant Examiner* — Jose M Diaz
(74) *Attorney, Agent, or Firm* — Ladas & Parry LLP

(57) ABSTRACT

The invention includes a lamp housing member having a circular upper plate and a side portion formed at the outer circumference of the upper plate, first light emitting diode modules that are provided on a lower surface of the upper plate and are supplied with power to emit light, and second light emitting diode modules that are mounted on the inner surface of the side portion and are supplied with power to emit light. According to the invention, it is possible to increase a light distribution area, achieve illumination with high brightness, and improve flexibility in the road lighting design. In addition, it is possible to easily ensure a cut-off-angle at which pedestrians or drivers cannot directly view the second light emitting diode modules by adjusting the inclination angle of the side portion.

9 Claims, 19 Drawing Sheets

(56) References Cited

U.S. PATENT DOCUMENTS

| | | | | |
|---|---|---|---|---|
| D377,399 | S * | 1/1997 | Kay | D26/68 |
| 5,920,643 | A | 7/1999 | White et al. | |
| D428,180 | S * | 7/2000 | Orellana et al. | D26/67 |
| 6,122,048 | A * | 9/2000 | Cochran et al. | 356/239.4 |
| 6,250,774 | B1 * | 6/2001 | Begemann et al. | 362/231 |
| 6,250,781 | B1 * | 6/2001 | Straus et al. | 362/375 |
| 6,331,063 | B1 | 12/2001 | Kamada et al. | |
| 6,648,495 | B1 * | 11/2003 | Hsu | 362/545 |
| 6,848,819 | B1 * | 2/2005 | Arndt et al. | 362/545 |
| 6,874,911 | B2 * | 4/2005 | Yoneda | 362/294 |
| 6,902,214 | B2 | 6/2005 | Smith | |
| 7,090,370 | B2 * | 8/2006 | Clark et al. | 362/183 |
| 7,152,996 | B2 * | 12/2006 | Luk | 362/240 |
| 7,285,903 | B2 * | 10/2007 | Cull et al. | 313/500 |
| 7,339,660 | B1 * | 3/2008 | Cohn et al. | 356/237.1 |
| D578,696 | S * | 10/2008 | Wang et al. | D26/70 |
| 7,686,469 | B2 * | 3/2010 | Ruud et al. | 362/101 |
| 7,712,927 | B2 * | 5/2010 | Shuai et al. | 362/294 |
| 7,988,331 | B2 * | 8/2011 | Zheng | 362/249.02 |
| 8,047,677 | B2 * | 11/2011 | Wang | 362/249.02 |
| 8,087,799 | B2 * | 1/2012 | Hahn et al. | 362/235 |
| 8,186,845 | B2 * | 5/2012 | Zheng | 362/183 |
| 2002/0001193 | A1 * | 1/2002 | Osawa et al. | 362/249 |
| 2003/0189831 | A1 * | 10/2003 | Yoneda | 362/294 |
| 2005/0180160 | A1 * | 8/2005 | Nelson | 362/555 |
| 2006/0232436 | A1 | 10/2006 | Ding et al. | |
| 2006/0250803 | A1 * | 11/2006 | Chen | 362/373 |
| 2008/0002413 | A1 * | 1/2008 | Wang et al. | 362/341 |
| 2008/0089070 | A1 * | 4/2008 | Wang | 362/294 |
| 2009/0079970 | A1 * | 3/2009 | Cohn et al. | 356/237.1 |

FOREIGN PATENT DOCUMENTS

| | | | |
|---|---|---|---|
| GB | 2 373 569 | A | 9/2002 |
| JP | 09-147089 | A | 6/1997 |
| JP | 3086473 | U | 3/2002 |
| JP | 2002-150807 | A | 5/2002 |
| JP | 2003-123505 | A | 4/2003 |
| JP | 2004-200102 | A | 7/2004 |
| JP | 2005-181290 | A | 7/2005 |
| JP | 2005-340184 | A | 12/2005 |
| JP | 2007-2442258 | A | 9/2007 |
| JP | 3134249 | U | 10/2007 |
| KR | 1020010012585 | A | 2/2001 |

OTHER PUBLICATIONS

Office Action of the Canadian Patent Office; Patent Appln. No. 2,712,171.

International Search Report: PCT/KR2008/001595.

Supplementary European Search Report dated Mar. 6, 2013; Appln. No. 08723632.9—1755/2235433; PCT/KR2008001595.

* cited by examiner

Fig. 1
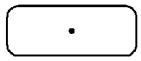
(a) FIRST LIGHT DISTRIBUTION TYPE
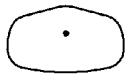
(b)SECOND LIGHT DISTRIBUTION TYPE
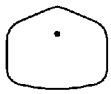
(c) THIRD LIGHT DISTRIBUTION TYPE
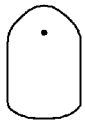
(d) FOURTH LIGHT DISTRIBUTION TYPE
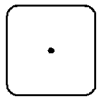
(e)FIFTH LIGHT DISTRIBUTION TYPE
Fig. 2
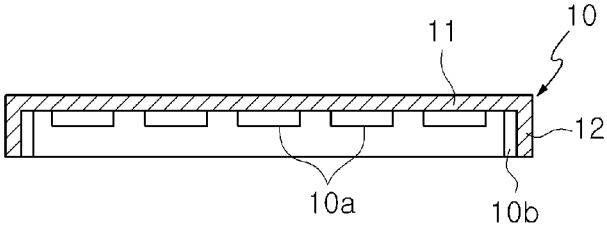
Fig. 3
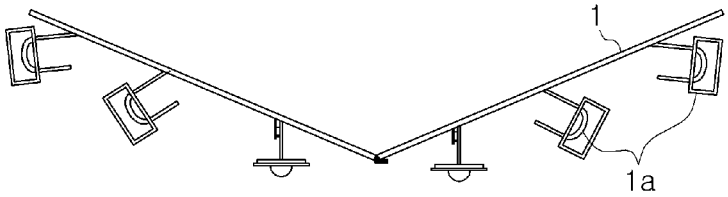

Fig. 4
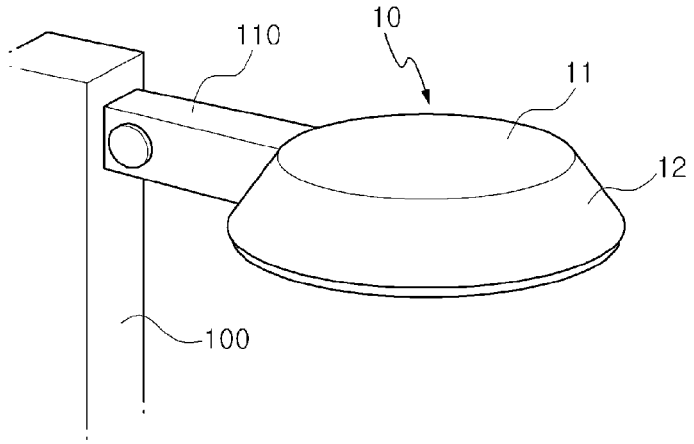
Fig. 5]
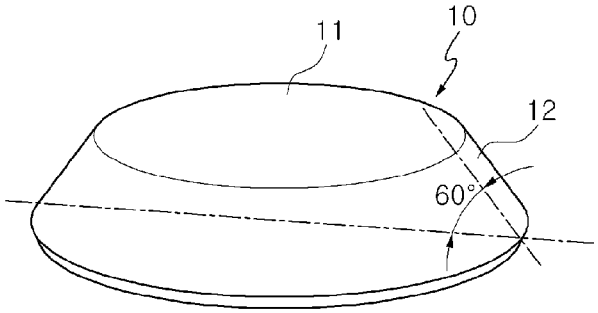
Fig. 6
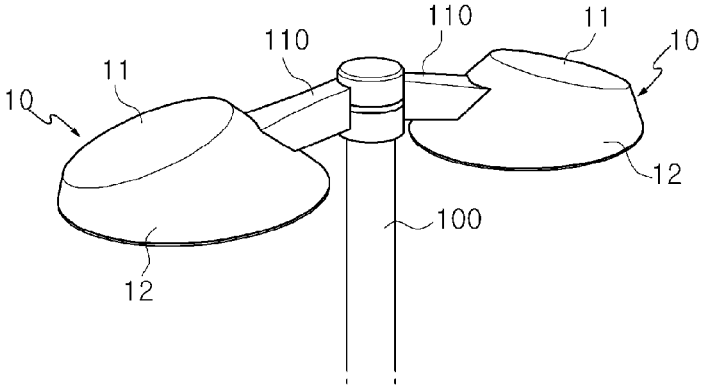
Fig. 7
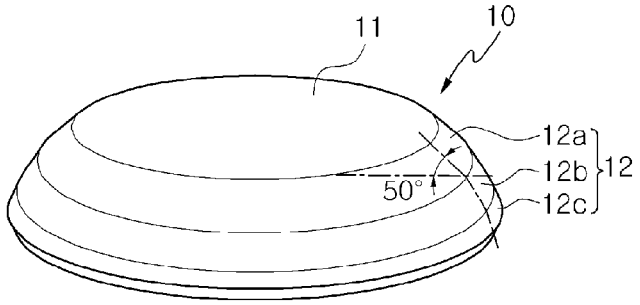

Fig. 30
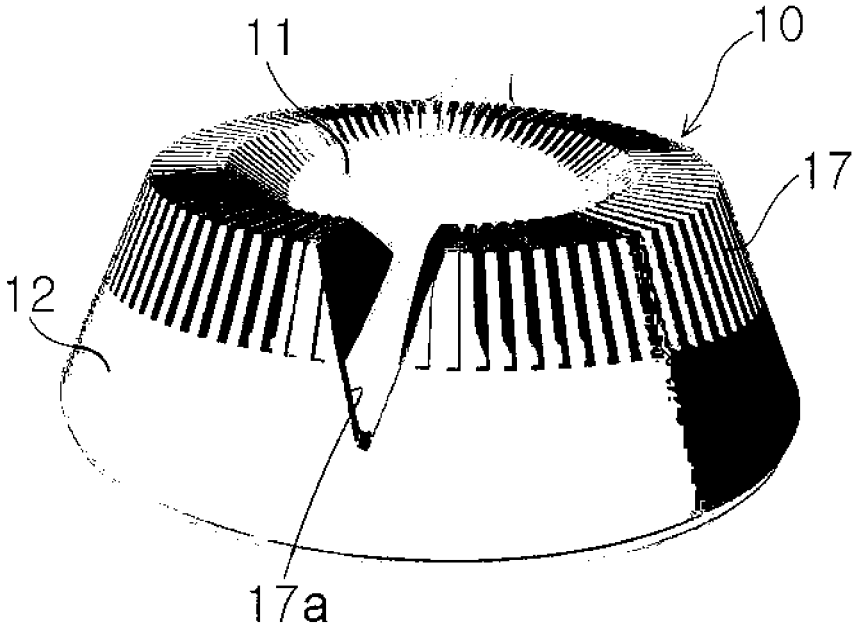
[Fig. 31
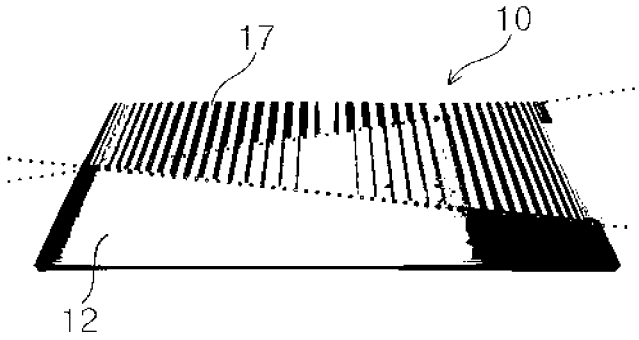

LIGHTING APPARATUS USING LIGHT EMITTING DIODE

TECHNICAL FIELD

The present invention relates to a lighting apparatus using light emitting diodes, and more particularly, to a lighting apparatus using a light emitting diode as a light source, which is designed to illuminate a wide range and be suitable for a light distribution type that is generally used to illuminate the road.

BACKGROUND ART

In general, streetlamps are lighting apparatuses that are installed along the road for safe road traffic, and various types of streetlamps are used according to the installation positions thereof, such as an expressway, main roads in the city, roads in a business section, and roads in a residence section.

The lighting apparatus includes a lamp housing that has a reflecting plate formed on the inner surface thereof and is mounted to a lamp post and a light source that is provided in the lamp housing to emit light.

The lamp posts are classified into various types, such as a highway type in which a lamp is attached to the end of a curved portion of a lamp post, a bracket type in which a lamp is attached to a branch horizontally extending a lamp post, and a column capital type in which a lamp is attached to the top of a lamp post.

In addition, a general lamp, such as a high-pressure sodium, metal halide, or a mercury vapor, is used as the light source.

The streetlamp emits predetermined color light, such as white, yellow, or blue light, according to the type of light source provided therein. Of course, the color of light emitted from the streetlamp may be selected according to, power efficiency, light intensity, or the surrounding environment.

Meanwhile, the streetlamp is designed to have a shape capable of most effectively illuminating the road with a suitable light distribution type when it is installed on the road. As shown in FIG. 1, first to five light distribution types are generally used to illuminate the road. Except for some special cases, the second to fourth light distribution types can effectively illuminate most of the road.

In the streetlamp according to the related art, the reflection angle of a reflecting plate provided in a lamp housing is adjusted to illuminate the road with a suitable light distribution type in the road light design.

However, it is difficult for the user to arbitrarily adjust the brightness and diffusion range of light emitted from various lamps, such as a high-pressure mercury lamp, a fluorescent lamp, and a sodium lamp, used as a light source in the streetlamp according to the related art, since the brightness and the diffusion range are fixed during the manufacture of the lamps, and the lamps have a very short life span and a large amount of power consumption.

In order to solve these problems, in recent years, a lighting apparatus using light emitting diodes (LEDs) as a light source has been proposed. In addition, with the development of technique, light emitting diodes with a small amount of power consumption and high brightness have been developed and come into widespread use.

As shown in FIG. 2, in the lighting apparatus using the light emitting diodes, generally, a plurality of light emitting diode modules 10*a* are mounted to the lower surface of an upper plate 11 of the lamp housing member 10, and a reflecting plate 10*b* is provided on the inner surface of a side portion 12 of the lamp housing member 10. The light emitting diode modules 10*a* and the reflecting plate 10*b* are used to illustrate the road.

In the lighting apparatus using the light emitting diodes, the plurality of light emitting diode modules 10*a* are mounted to the lower surface of an upper plate 11 in order to ensure a cut-off-angle at which pedestrians or drivers cannot directly view the light emitting diode modules within a predetermined angle range.

In a lighting apparatus including the light emitting diodes as well as the lighting apparatus using the light emitting diodes, when light from light source is directly emitted to the pedestrians or drivers, light is likely to hinder the walking of the pedestrians or the driving of the drivers, which may cause traffic accidents. Therefore, it is essential to ensure the cut-off-angle.

The light emitting diode has a substantially permanent life span, as compared to the lamps according to the related art, and the brightness of light emitted from the light emitting diodes is determined by a combination of the light emitting diodes. However, when light distribution is formed by the reflecting plate, a light distribution area is small, and brightness is low. In addition, there are limitations in forming sufficient light distribution to effectively illuminate the road surface, that is, in forming the first to fifth light distribution types.

Further, since it is difficult to effectively dissipate heat generated from a plurality of light emitting diodes, emission efficiency is lowered due to heat, which results in the damage of parts.

Therefore, the lighting apparatus using the light emitting diodes depends on only the reflecting plate to provide desired brightness except for the ideal arrangement of the light emitting diodes during manufacture. As a result, the lighting apparatus using the light emitting diodes is ineffective to illuminate the road, and is not used in the wide range.

Further, a lighting apparatus using light emitting diodes shown in FIG. 3 has been proposed in which a plurality of light emitting diode modules la are mounted to a V-shaped lamp mounting frame 1 at predetermined intervals.

The lighting apparatus using the light emitting diodes can adjust light distribution and a light distribution area by adjusting the angle of the lamp mounting frame 1. However, there are limitations in the adjustment of the angle, and since the light emitting diode modules 1*a* are exposed to the outside, light emitted from the light emitting diode modules is directly emitted to the eye of the pedestrian or the driver, which may interfere with safe walking or driving due to glare.

DISCLOSURE OF INVENTION

Technical Problem

An object of the invention is to provide a lighting apparatus using light emitting diodes that has a large light distribution area and high brightness and is capable of forming various light distributions to effectively illuminate the road.

Another object of the invention is to provide a lighting apparatus using light emitting diodes that is capable of easily ensuring a cut-off-angle at which pedestrians or drivers cannot directly view light emitting diode modules within a predetermined angle range.

Still another object of the invention is to provide a lighting apparatus using light emitting diodes that is capable of easily obtaining a desired light distribution by adjusting the mounting angles of light emitting diode modules, and improving flexibility in the lighting design.

Technical Solution

In order to achieve the objects, according to an aspect of the invention, there is provided a lighting apparatus using light emitting diodes. The lighting apparatus includes: a lamp housing member that has a circular upper plate and an inclined side portion formed at an outer circumference of the upper plate; first light emitting diode modules that are provided on a lower surface of the upper plate; and second light emitting diode modules that are provided on an inner surface of the side portion.

Advantageous Effects

According to the invention, the first light emitting diode modules mounted to the lower surface of the upper plate and the second light emitting diode modules mounted to the inner surface of an inclined side portion are used to illuminate the road. Therefore, it is possible to illuminate the road with a large light distribution area and high brightness.

Further, according to the invention, it is possible to freely form the first to fifth light distribution types that are mainly used to illuminate the road by adjusting the mounting angles and the number of second light emitting diode modules mounted to the inner surface of the side portion. Therefore, it is possible to improve flexibility in the road lighting design.

Furthermore, according to the invention, it is possible to easily ensure a cut-off-angle at which pedestrians or drivers cannot directly view the second light emitting diode modules within a predetermined angle range by adjusting the inclination angle of the side portion.

BRIEF DESCRIPTION OF DRAWINGS

FIG. 1 is a diagram schematically illustrating general light distribution types;

FIGS. 2 and 3 are diagrams schematically illustrating a lighting apparatus using light emitting diodes according to the related art;

FIGS. 4 and 5 are perspective views illustrating an embodiment of the invention;

FIG. 6 is a perspective view illustrating another embodiment of the invention;

FIGS. 7 to 9 are perspective views illustrating still another embodiment of the invention;

FIG. 30 is a perspective view illustrating an example of a lamp housing member according to the invention;

FIG. 31 is a side view illustrating another example of the lamp housing member according to the invention;

DESCRIPTION OF REFERENCE NUMERALS IN THE DRAWINGS

Figure 8:
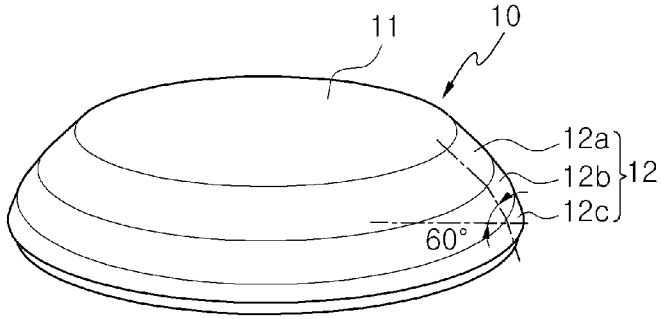

10: lamp housing member
11: upper plate
12: side portion
13: transparent panel member
14: fixing plate
15: bolt
16: packing ring
17: heat sink
18: angle adjusting block
20: first light emitting diode module
30: second light emitting diode module
40: inclined block member

BEST MODE FOR CARRYING OUT THE INVENTION

Hereinafter, exemplary embodiments of the invention will be described in detail with reference to the accompanying drawings.

FIGS. 4 and 5 are perspective views illustrating an embodiment of the invention, and show an example of a lamp housing member having an upper plate that is parallel to a road surface and a side portion composed of one inclined plane.

FIG. 6 is a perspective view illustrating another embodiment of the invention, and shows an example of a lamp housing member having an upper plate that is inclined at a predetermined angle with respect to the horizontal plane parallel to a road surface.

Figure 9:
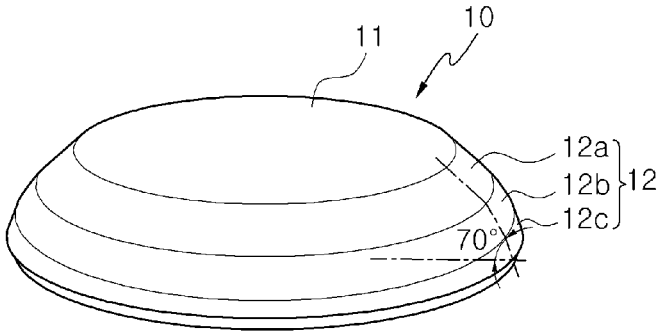

FIGS. 7 to 9 are perspective views illustrating still another embodiment of the invention, and show an example of a lamp housing member having a side portion that includes a plurality of inclined planes inclined at different angles.

Figure 10:
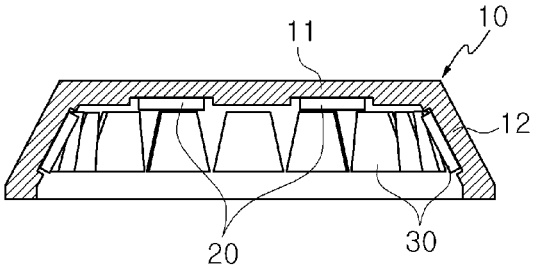
FIG. 10 is a longitudinal cross-sectional view illustrating an example of the invention.

FIG. 10 is a longitudinal cross-sectional view illustrating an embodiment of the invention, and shows a first light emitting diode module and a second light emitting diode module that are mounted to the lower surface of the upper plate and the inner surface of the side portion, respectively.

Figure 11:
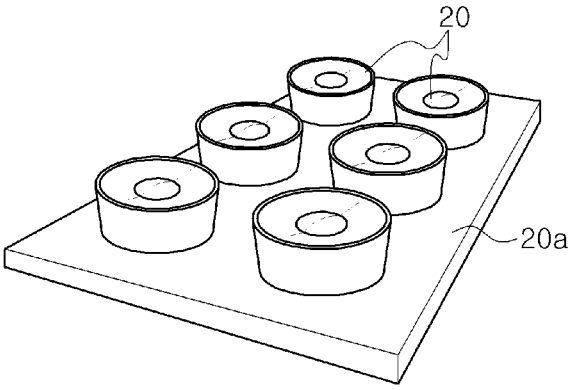
FIG. 11 is a perspective view illustrating light emitting diode modules according to the invention.

FIG. 11 is a perspective view schematically illustrating the light emitting diode modules according to the invention, and shows an example of the structure of a plurality of light emitting diode modules that are mounted to a metal printed circuit board and supplied with power to emit light.

Figure 12:
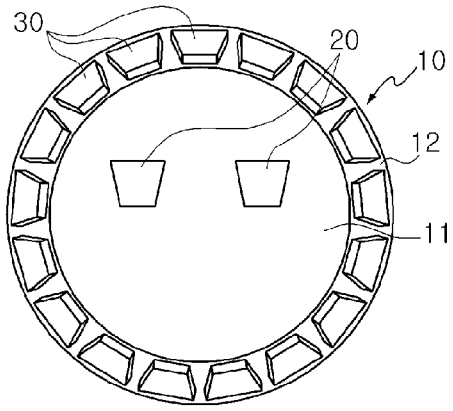
FIGS. 12 and 13 are bottom views illustrating an embodiment of the invention.
Figure 13:
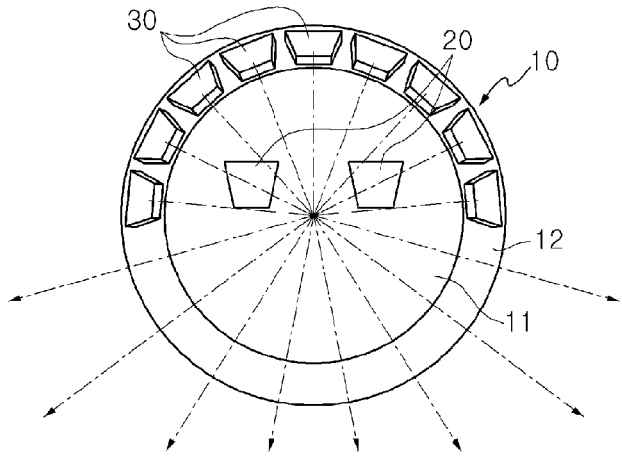
Figure 14:
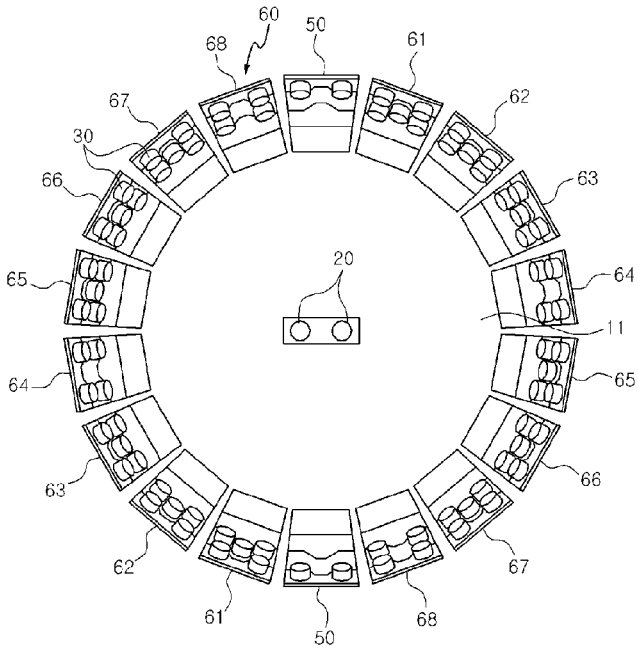
FIGS. 14 and 15 are bottom views illustrating another embodiment of the invention.
Figure 15:
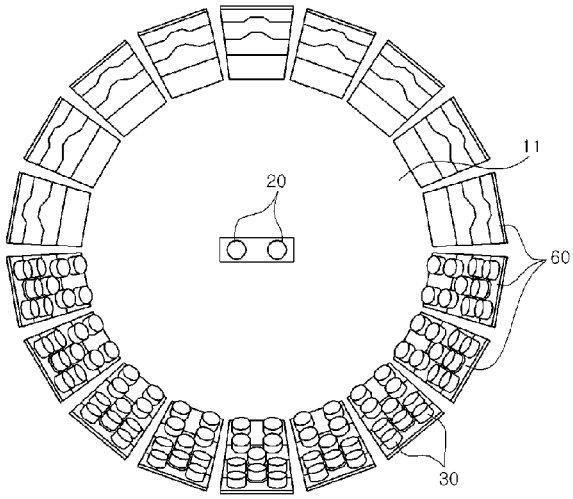

FIGS. 12 and 13 are bottom views illustrating an embodiment of the invention, and FIGS. 14 and 15 are bottom views illustrating another embodiment of the invention. FIGS. 12 and 14 show a plurality of second light emitting diode modules that are mounted on the entire inner surface of the side portion at predetermined intervals, and FIGS. 13 and 15 show a plurality of second light emitting diode modules that are mounted on a portion of the side portion at predetermined intervals.

Figure 16:
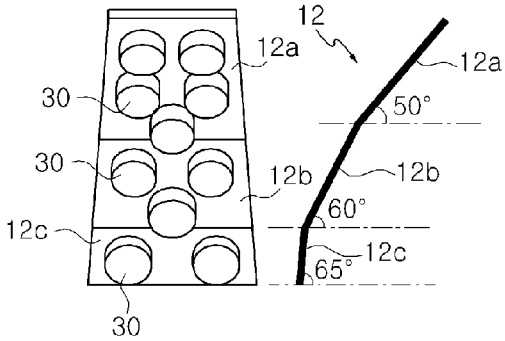
FIGS. 16 to 18 are enlarged views illustrating examples of the mounting of second light emitting diode modules according to the invention.
Figure 17:
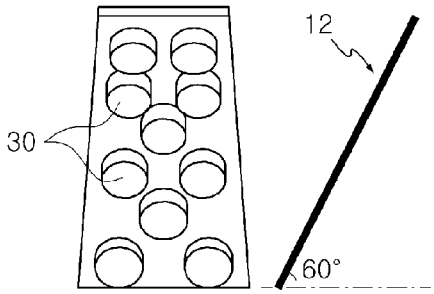
Figure 18:
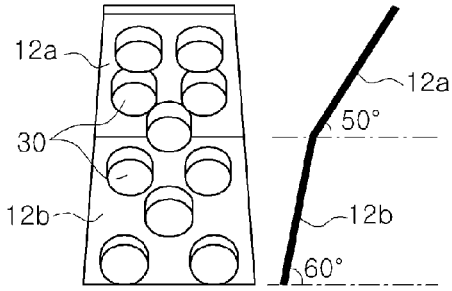

FIGS. 16 to 18 are enlarged views illustrating examples of the mounting of the second light emitting diode modules, and show examples of mounting a plurality of light emitting diode modules on the inner surfaces of the side portions having different inclination angles.

Figure 19:
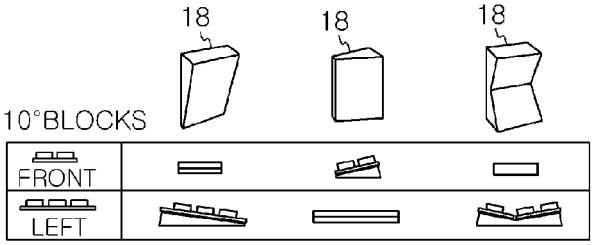
FIG. 19 is a diagram illustrating angle adjusting blocks according to the invention.

FIG. 19 is a diagram illustrating angle adjusting blocks according to the invention, and shows various shapes of the angle adjusting block that can adjust the mounting angle of the second light emitting diode module by an angle of 10°.

Figure 20:
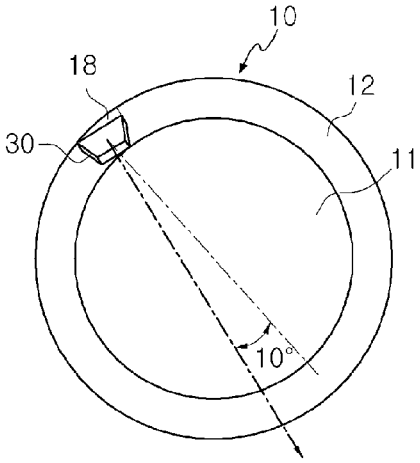
FIGS. 20 to 23 are cross-sectional views illustrating examples of the usage of the angle adjusting blocks shown in FIG. 19.
Figure 21:
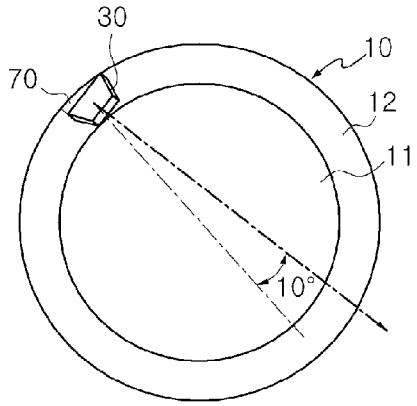
Figure 22:
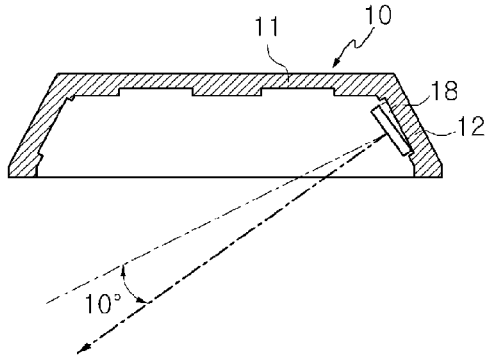
Figure 23:
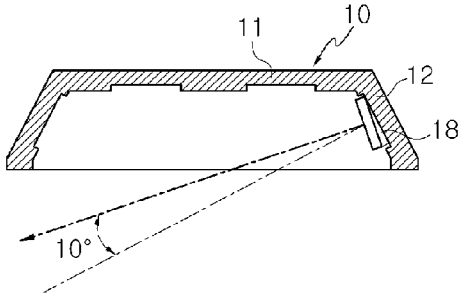

FIGS. 20 to 23 are cross-sectional views illustrating the usage of the angle adjusting block shown in FIG. 19. FIGS. 20 and 21 show an example of adjusting the angle of the second light emitting diode module by 10° in the horizontal direction, and FIGS. 22 and 23 show an example of adjusting the angle of the second light emitting diode module by 10° from the original angle in the vertical direction.

Figure 24:
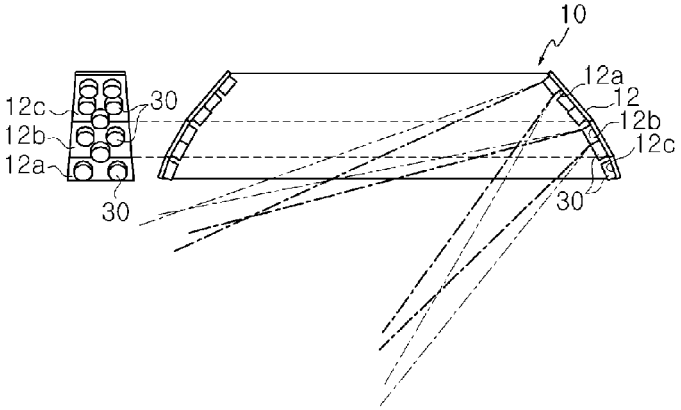
FIGS. 24 to 26 are diagrams schematically illustrating examples of a cut-off-angle according to the invention.
Figure 25:
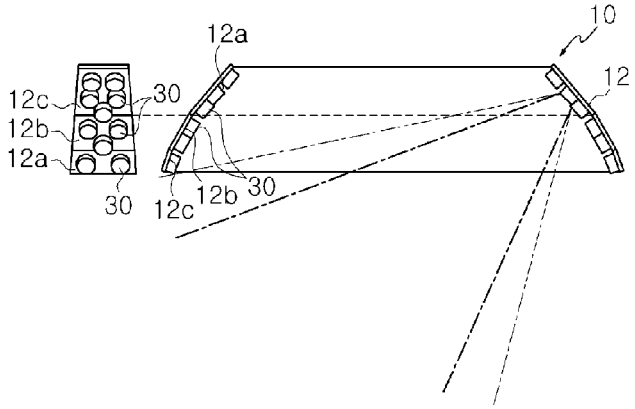
Figure 26:
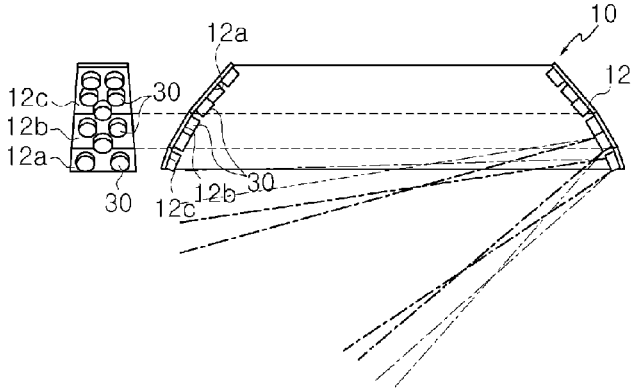

FIGS. 24 to 26 are diagrams schematically illustrating examples of a cut-off-angle according to the invention, and show examples of ensuring the cut-off-angle at which pedestrians or drivers cannot directly view the emitting diode modules mounted to the side portion including inclined planes, which are inclined at different angles, within a predetermined angle.

Figure 27:
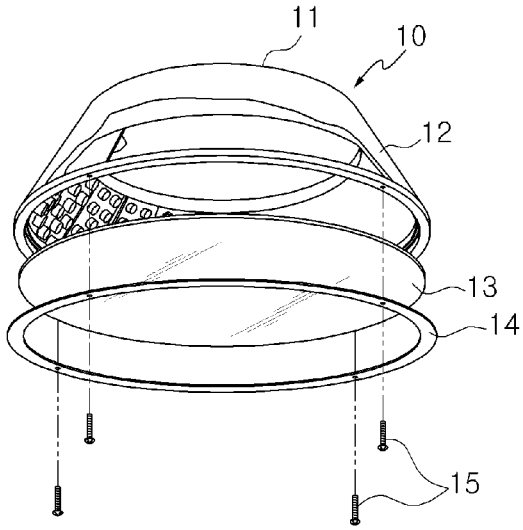
FIG. 27 is an exploded perspective view illustrating an embodiment of the invention.

FIG. 27 is an exploded perspective view illustrating an embodiment of the invention, and shows an example of mounting a transparent panel member to a lower part of the lamp housing member.

Figure 28:
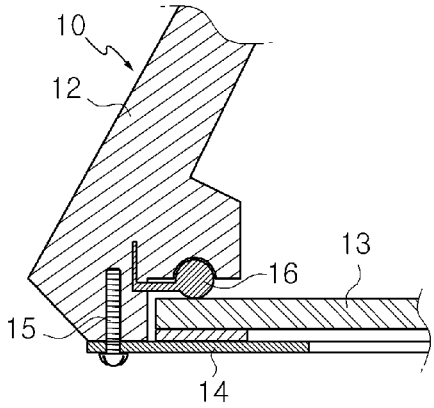
FIGS. 28 and 29 are enlarged perspective views illustrating an embodiment of the invention.
Figure 29:
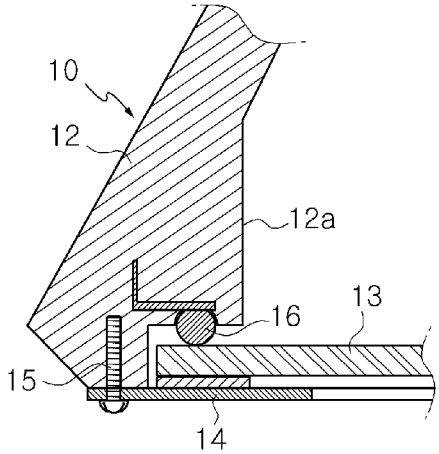

FIGS. 28 and 29 are enlarged cross-sectional views illustrating an embodiment of the invention. Specifically, FIGS. 28 and 29 are partially enlarged cross-sectional views illustrating the transparent panel member mounted to a power part of the side portion of the lamp housing member, and show the shapes of the inner surfaces of the side portions.

FIG. 30 is a perspective view illustrating an example of the lamp housing member according to the invention, and shows the lamp housing member having a heat sink for dissipating heat at its upper part.

FIG. 31 is a side view illustrating another example of the lamp housing member according to the invention, and shows an example of the shape of a heat sink of a lamp housing member having an inclined upper plate.

Figure 32:
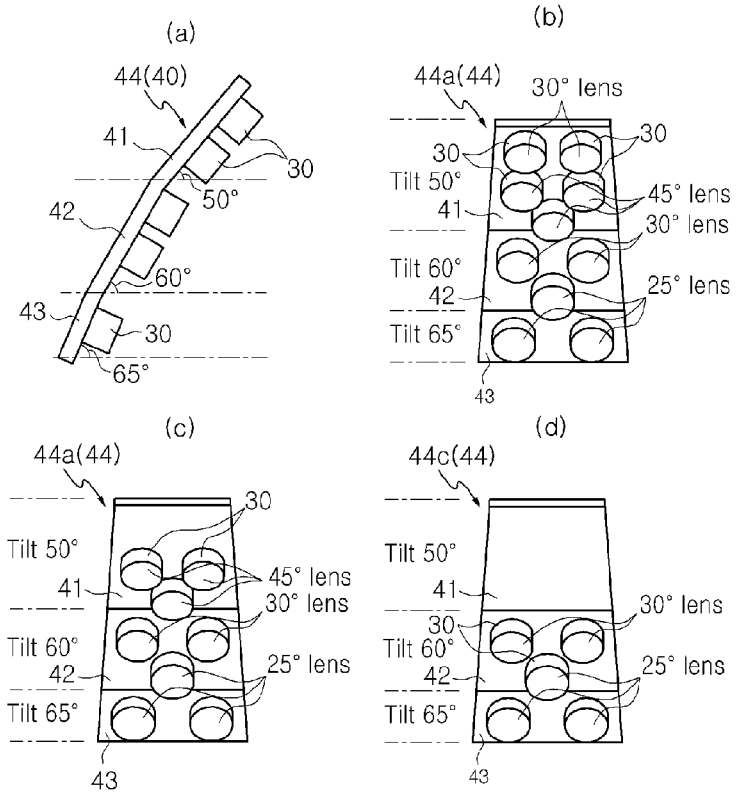
FIGS. 32 to 34 are diagrams schematically illustrating examples of inclined block members according to the invention.
Figure 33:
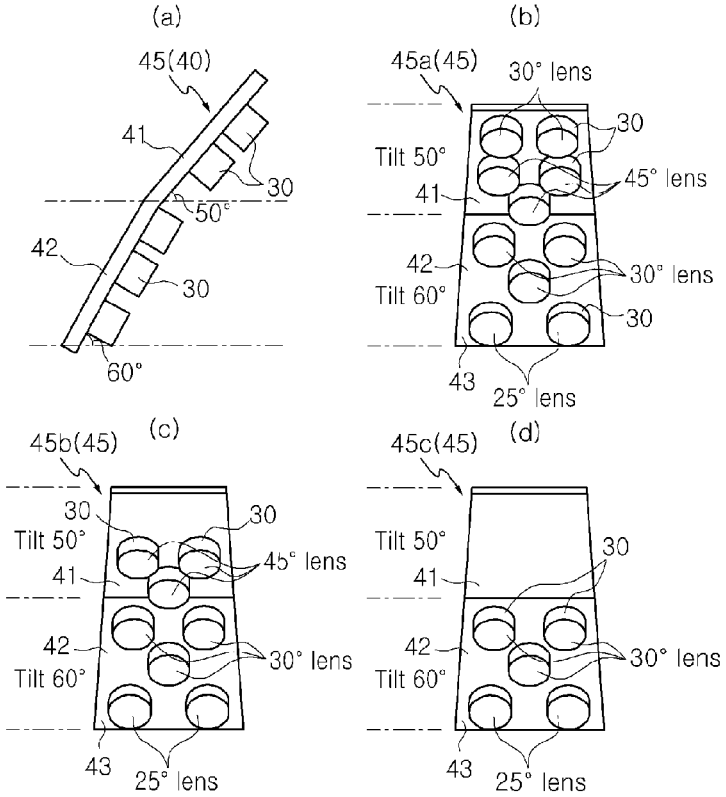
Figure 34:
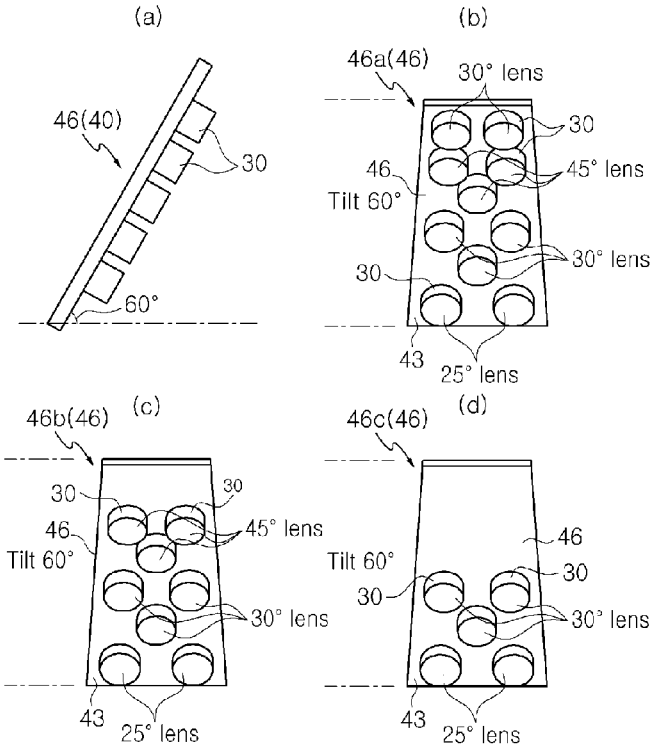

FIGS. 32 to 34 are diagrams schematically illustrating examples of an inclined block member according to the invention, and show examples of a three-stage block, a two-stage block, and a single-stage block, respectively.

FIGS. 35 to 48 are diagrams illustrating other embodiments of the invention, and show a second light distribution type, a third light distribution type, and a fourth light distribution type.

As shown in FIG. 4, a lamp housing member 10 according to the invention is mounted to an arm member 110 that extends from the top of a lamp post 100, which is erected in the vertical direction with respect to the road surface, to one side.

The lamp housing member 10 basically includes an upper plate 11 that has a circular shape and is parallel to the road surface and a side portion 12 that is formed along the outer circumference of the upper plate 11 and is inclined at an acute angle with respect to the upper plate 11.

As shown in FIG. 5, the side portion 12 is basically inclined at an angle of 60 with respect to a horizontal plane that is parallel to the road surface. However, the side portion may be inclined at various angles according to light distribution in the road lighting design.

Further, as shown in FIG. 6, a lamp housing member 10 according to the invention basically includes an upper plate 11 that has a circular shape and is inclined downward from one end to the other end of a horizontal line that is parallel to the road surface, and a side portion 12 that is formed along the outer circumference of the upper plate 11 and is inclined at an acute angle with respect to the upper plate 11.

The upper plate 11 is formed such that it is inclined downward using a point where the upper plate 11 is connected to the arm member 110 as the center of the upper plate 11. In this case, the side portion 12 has a lower end that is parallel to the ground, and is formed such that the area of the surface to which second light emitting diode modules 30 are mounted is gradually decreased from a portion of the inner surface facing the road to a portion of the inner surface facing the lamp post 100.

Therefore, the number of second light emitting diode modules 30 mounted to the inner surface of the side portion 12 is gradually decreased from a portion of the inner surface facing the road to a portion of the inner surface facing the lamp post 100.

According to this structure, it is possible to mount a sufficient number of second light emitting diode modules 30 to illuminate the road, and reduce the number of second light emitting diode modules 30 that do not illuminate the road. As a result, it is possible to sufficiently illuminate the road and form sufficient light distribution with a small number of second light emitting diode modules 30, and thus reduce manufacturing costs.

Furthermore, since the upper plate 11 is inclined, it is easy to mount a heat sink 17, which will be described below, to an upper part of the upper plate. In addition, it is easy to design and manufacture the lamp housing member 10 to perform concentrated illumination in one direction. As a result, it is possible to reduce manufacturing costs.

Moreover, as shown in FIGS. 7 to 9, a lamp housing member 10 according to the invention includes a circular upper plate 11 and a side portion 12 that is formed along the outer circumference of the upper plate 11 and is inclined at an acute angle with respect to the upper plate 11. The side portion 12 includes a plurality of inclined planes that are inclined at different angles.

The side portion 12 includes a plurality of inclined planes that extend from the bottom of the upper plate 11. In the invention, the inclined planes sequentially extend from the bottom of the upper plate 11 and have different inclination angles. The inclines planes basically include first to third inclined planes 12*a*, 12*b*, and 12*c*. The third incline plane 12*c* is inclined at the largest angle with respect to a horizontal plane parallel to the road surface, followed by the second and first planes 12*b* and 12*a*.

The first inclined plane 12*a* is inclined 50° with respect to the horizontal plane parallel to the road surface, the second inclined plane 12*b* is inclined 60° with respect to the horizontal plane parallel to the road surface, and the third inclined plane 12*c* is inclined 70° with respect to the horizontal plane parallel to the road surface. However, the inclination angles of the inclined planes may vary according to light distribution in the road lighting design.

Meanwhile, as shown in FIG. 10, the first and second light emitting diode modules 20 and 30 are mounted to the lower surface of the upper plate 11 and the inner surface of the side portion 12, respectively.

As shown in FIG. 11, the first and second light emitting diode modules 20 and 30 each include a light emitting diode (LED) chip (not shown) that is mounted on a metal printed circuit board (PCB) 20*a* and is supplied with power to emit light, and a lens unit and/or reflector (not shown) that focuses light emitted from the light emitting diode chip.

The lens unit of each of the first and second light emitting diode modules 20 and 30 focuses light emitted from the light emitting diode chip to adjust a light emission range. For example, as the lens unit, a 12°lens, a 25° lens, a 30° lens, or a 45° lens is used according to the light emission range.

This has been known in the art, and thus a detailed description thereof will be omitted. This is similarly applied to the first and second light emitting diode modules 20 and 30.

Only one first light emitting diode module 20 may be mounted to the lower surface of the upper plate 11, or a plurality of first light emitting diode modules 20 may be mounted to the lower surface of the upper plate 11 at predetermined intervals.

The mounting position and the number of first light emitting diode modules 20 may depend on light distribution, brightness, and a light distribution area in the lighting design.

As shown in FIGS. 12 and 14, a plurality of second light emitting diode modules 30 are provided along the circumference of the inner surface of the side portion 12 at predetermined intervals.

FIG. 12 shows an example in which a plurality of rows of second light emitting diode modules 30 are mounted to the entire inner surface of the side portion 12 having one inclined plane at predetermined intervals.

FIG. 14 shows an example in which a plurality of mounting portions to which a plurality of second light emitting diode modules 30 are mounted are provided at predetermined intervals on the entire inner surface of the side portion 12 including the first to third inclined planes 12*a*, 12*b*, and 12*c*, which sequentially extend from the bottom of the upper plate 11 and have different inclination angles, such that the mounting portions are symmetric with respect to the center of the upper plate 11.

The mounting portions uniformly divide the inner surface of the side portion 12 on the basis of the center of the upper plate 11, and include a pair of base mounting portions 50 that are positioned on a reference line passing through the center of the lamp housing member 10 at a point where the lamp housing member 10 is mounted to an arm member 110 of the lamp post 100, and a plurality of side mounting portions 60 that are symmetrically formed with respect to the center of the reference line linking the pair of base mounting portions 50 at predetermined intervals so as to face each other.

In FIG. 14, the first to third inclined planes 12*a*, 12*b*, and 12*c* are respectively inclined 50°, 60°, and 65° with respect to the horizontal plane that is parallel to the road. The base mounting portions 50 and the side mounting portions 60 divide the inner surface into 18 parts. The side mounting portions 60 include pairs of first to eighth side mounting portions 61, 62, 63, 64, 65, 66, 67, and 68 that are symmetric with respect to the center of the upper plate 11 between a pair of base mounting portions 50.

The base mounting portions 50 each has two second light emitting diode modules 30 mounted thereto, and the first to eighth side mounting portions 61, 62, 63, 64, 65, 66, 67, and 68 are provided at predetermined intervals such that they are rotated 20°, 40°, 50°, 70°, 110°, 130°, 140°, and 160° with respect to the base mounting portion 50, respectively. The first, second, third, fifth, sixth, and seventh side mounting portions 61, 62, 63, 65, 66, and 67 each have five second light emitting diode modules 30, and the fourth and eighth side mounting portions 64 and 68 each have four second light emitting diode modules 30.

In this case, two first light emitting diode modules 20 are mounted to the lower surface of the upper plate 11, and the lamp housing member 10 has a diameter of 620 mm. The first and second light emitting diode modules 20 and 30 include light emitting diodes of 2.5 W (3.5×700 mA) and 150 lm, and form a third light distribution type in FIG. 1.

As shown in FIGS. 13 and 15, the second light emitting diode modules 30 are mounted to a portion of the inner surface of the side portion 12 at predetermined intervals.

FIG. 13 shows an example in which a plurality of rows of second light emitting diode modules 30 are mounted to a portion of the inner surface of the side portion 12 having one inclined plane.

FIG. 15 shows an example in which a plurality of mounting portions 60 to which a plurality of second light emitting diode modules 30 are mounted are provided at pre-determined intervals on the entire inner surface of the side portion 12 including the first to third inclined planes 12*a*, 12*b*, and 12*c*, which sequentially extend from the bottom of the upper plate 11 and have different inclination angles, such that 18 mounting portions are symmetric with respect to the center of the upper plate 11.

In FIG. 15, basically, ten second light emitting diode modules 30 are mounted to each of a continuous series of 7 side mounting portions 60 among the 18 side mounting portions 60, and 5 second light emitting diode modules 30 are mounted to each of two side mounting portions 60 positioned at both sides of a continuous series of 7 side mounting portions 60.

In this case, two first light emitting diode modules 20 are mounted to the lower surface of the upper plate 11, and the lamp housing member 10 has a diameter of 620 mm. The first and second light emitting diode modules 20 and 30 include light emitting diodes of 2.5 W (3.5×700 mA) and 150 lm, and form a fifth light distribution type in FIG. 1.

In FIGS. 13 and 15, a portion of the inner surface of the side portion 12 to which the second light emitting diode modules 30 are mounted means a portion of the inner surface facing the road at the point where the lamp housing member 10 is mounted to the arm member 110 of the lamp post 100. A minimum number of second light emitting diode modules 30 for illuminating the road are provided on the inner surface of the side portion 12 facing the road. In this way, it is possible to improve flexibility in the road lighting design, reduce manufacturing costs, and minimize power consumption.

This structure is used when the lamp post 100 is installed adjacent to a wall or a building illuminate and it is unnecessary to illuminate a space in the inward direction of the lamp posit, that is, a space in the opposite direction of the arm member 110. However, this structure may vary according to the lighting design of a lamp post.

As shown in FIG. 16, the first to third inclined planes 12*a*, 12*b*, and 12*c* of the side portion 12 may be inclined 50°, 60°, and 65° with respect to the horizontal plane parallel to the road surface, respectively.

In the example in which ten second light emitting diode modules 30 are mounted, two second light emitting diode modules 30 each having a 30° diode lens and three second light emitting diode modules 30 each having a 45° diode lens are mounted to the first inclined plane 12*a*. Two second light emitting diode modules 30 each having a 30° diode lens and one second light emitting diode module 30 having a 25° diode lens are mounted to the second inclined plane 12*b*. Two second light emitting diode modules 30 each having a 25° diode lens are mounted to the third inclined plane 12*c*.

FIG. 17 shows an example in which ten second light emitting diode modules 30 are mounted to the side portion 12 having one inclined plane. FIG. 18 shows an example in which ten second light emitting diode modules 30 are mounted to the side portion 12 having the first inclined plane

12*a* that is inclined 50° and the second inclined plane 12*b* that is inclined 60°. The shape of the side portion 12 is changed to adjust a light distribution area and a cut-off-angle while maintaining light distribution.

As described above, it is possible to form various light distributions by adjusting the inclination angle of the side portion 12, that is, the mounting angle, the mounting position, and the number of second light emitting diode modules 30, and to form the most effective light distribution in the road lighting design. As a result, it is possible to improve flexibility in the road lighting design and the lighting efficiency of the road.

Further, it is possible to adjust a light distribution area and a cut-off-angle at which the pedestrians or drivers cannot directly view the light emitting diode modules by adjusting the inclination angle and the inclined plane of the side portion 12, and thus further improve flexibility in the road lighting design.

Furthermore, in the lamp housing member 10 according to the invention, angle adjusting blocks 18 capable of adjusting the mounting angle of the second light emitting diode modules 30 may be inserted between the second light emitting diode modules 30 and the inner surface of the side portion 12 to which the second light emitting diode modules 30 are mounted.

In the invention, the light distribution and the cut-off-angle may vary according to, for example, the inclination angle of the side portion 12, the mounting angle of the second light emitting diode module 30, and the number of second light emitting diode modules 30. The angle adjusting blocks 18 are mounted to the inner surface of the side portion 12 to adjust the mounting angles of the second light emitting diode modules 30, which makes it possible to improve flexibility in the road lighting design.

FIG. 19 shows various shapes of the angle adjusting block 18 capable of adjusting the mounting angle by 10°.

As shown in FIG. 19, the angle adjusting block 18 may be formed to have an inclined plane in the vertical direction or in the horizontal direction, or it may be formed to have a pair of inclined planes facing each other. The angle adjusting block 18 may be formed in any shape of inclined plane as long as it can adjust the mounting angle of the second light emitting diode module 30.

As shown in FIGS. 20 to 23, the angle adjusting block 18 is mounted between the second light emitting diode module 30 and the mounting surface of the side portion 12 to adjust the mounting angle of the second light emitting diode module 30. FIGS. 20 and 21 show an example in which the angle adjusting block 18 is mounted to the mounting surface of the second light emitting diode module 30 to adjust the mounting angle of the second light emitting diode module 30 by 10° in the horizontal direction. FIGS. 22 and 23 show an example in which the angle adjusting block 18 is mounted to the mounting surface of the second light emitting diode module 30 to adjust the mounting angle of the second light emitting diode module 30 by 10° in the vertical direction.

Meanwhile, as shown in FIGS. 24 to 26, the invention adjusts the inclination angle and the inclined plane of the side portion 12 to adjust a light distribution area and a cut-off-angle at which the pedestrians or the drivers cannot directly view the light emitting diode module. In this way, it is possible to further improve flexibility in the road lighting design.

In the invention, FIGS. 24 to 26 show an example in which ten second light emitting diode modules 30 are mounted to the side portion 12 including the first to third inclined planes 12*a*, 12*b*, and 12*c* that are inclined 50°, 60°, and 65° with respect to the horizontal plane parallel to the road surface, respectively. In the example, two second light emitting diode modules 30 each having a 30° diode lens and three second light emitting diode modules 30 each having a 45° diode lens are mounted to the first inclined plane 12*a*, two second light emitting diode modules 30 each having a 30° diode lens and one second light emitting diode module 30 having a 25° diode lens are mounted to the second inclined plane 12*b*, and two second light emitting diode modules 30 each having a 25° diode lens are mounted to the third inclined plane 12*c*.

FIG. 24 shows the cut-off-angle of the second light emitting diode module 30 having the 30° diode lens in the above-mentioned example. FIG. 25 shows the cut-off-angle of the second light emitting diode module 30 having the 45° diode lens in the above-mentioned example. FIG. 26 shows the cut-off-angle of the second light emitting diode module 30 having the 25° diode lens in the above-mentioned example. These cut-off-angles are included in the cut-off-angle range for road safety.

Although not shown in the drawings, a cut-off-angle ensuring portion that protrudes to a predetermined height from the bottom of the side portion 12 and has no second light emitting diode module 30 mounted thereto is formed at a lower part of the side portion 12. In this way, it is possible to ensure a large cut-off-angle.

The cut-off-angle ensuring portion is formed at a lower part of the inner surface of the side portion 12 that faces the viewing direction of the driver in the traveling direction of vehicles on the road. The cut-off-angle ensuring portion may vary according to the viewing direction of the pedestrian or the driver, a lighting range, and light distribution in the road lighting design.

As shown in FIG. 27, a transparent panel member 13 for covering an opening portion is mounted to the side portion 12 of the lamp housing member 10 to protect the first and second light emitting diode modules 20 and 30 and to prevent foreign materials from getting into the side portion 12.

The transparent panel member 13 is formed of a transparent or opaque material, such as glass or synthetic resin, and transmits light emitted from the first and second light emitting diode modules 20 and 30.

The transparent panel member 13 has a ring-shaped fixing plate 14 formed at the outer circumference of a lower surface thereof.

The transparent panel member 13 is fastened to the lower surface of the side portion 12 by bolts 15.

As shown in FIGS. 28 and 29, a packing ring 16 is provided between the lower surface of the side portion 12 and the transparent panel member 13 to seal between the transparent panel member 13 and the side portion 12.

As shown in FIG. 28, a step portion for mounting the transparent panel member 13 may be formed at the lower end of the side portion 12. As shown in FIG. 29, an angle ensuring portion 12*a* may be formed which extends downward in the vertical direction from the inner surface of the side portion 12 and has no second light emitting diode module 30 mounted thereto. This shape makes it possible to improve convenience to manufacture a mold.

As shown in FIG. 30, it is preferable that a heat sink 17 for dissipating heat be provided at the top of the lamp housing member 10 according to the invention.

The heat sink 17 includes a plurality of fins or radiation fins that are arranged at the top of the lamp housing member 10 at predetermined intervals, thereby increasing a heat transmission area. In this way, the heat sink dissipates heat generated from the first and second light emitting diode modules 20 and 30 to prevent the breakdown of the first and second light emitting diode modules 20 and 30 due to heat, thereby lengthening the life span of the first and second light emitting diode modules 20 and 30.

Further, it is preferable that a drain outlet 17*a* for draining water be formed in the heat sink 17 in order to easily drain water when it rains or snows. The drain outlet makes it possible to prevent an electric leakage or the breakdown of the first and second light emitting diode modules 20 and 30 due to water.

Furthermore, in the lamp housing member 10 including the upper plate 11 that has a circular shape and is inclined downward from one end to the other end of a horizontal line that is parallel to the road surface and the side portion 12 that is formed along the outer circumference of the upper plate 11 and is inclined at an acute angle with respect to the upper plate, preferably, the lower end of the heat sink 17 is inclined in the opposite direction of the direction in which the upper plate 11 is inclined such that the radiation area of the heat sink gradually increases from the other end to one end of the upper plate 11.

In this structure, a large number of second light emitting diode modules 30 are mounted to the side portion 12 positioned at one side of the upper plate 11 of the lamp housing member 10, and the number of second light emitting diode modules 30 is gradually decreased toward the other side. In addition, in other embodiments, no second light emitting diode module 30 is mounted to the other side. Therefore, it is possible to effectively dissipate heat by increasing the radiation area of the heat sink 17 at one side where a large number of second light emitting diode modules 30 are mounted.

Meanwhile, the invention includes inclined block members 40 each of which has one or more inclined planes to which a plurality of second light emitting diode modules 30 are mounted and is mounted to the inner surface of the side portion 12 of the lamp housing member 10. According to this structure, it is possible to illuminate the road with light distribution for streetlight, that is, first to fifth light distribution types.

The inclined block member 40 is interposed between the second light emitting diode modules 30 on the inner surface of the side portion 12.

Next, an embodiment of the invention including the inclined block members 40 will be described. The following embodiment may be similarly applied to the lamp housing member 10 including the side portion 12 having a plurality of inclined planes with different inclination angles.

As shown in (*a*) of FIG. 32, the inclined block member 40 includes an upper inclined portion 41, a middle inclined portion 42, and a lower inclined portion 43 that are inclined at arbitrary angles with respect to a horizontal line that is parallel to the ground. That is, the inclined block member includes a three-stage block 44 of the lower inclined portion 43, the middle inclined portion 42, and the upper inclined portion 41. In this case, the inclination angle of the lower inclined portion 43 is the largest, followed by the middle inclined portion 42 and the upper inclined portion 41.

In the invention, the lower inclined portion 43 is inclined 65° with respect to the horizontal line parallel to the ground, the middle inclined portion 42 is inclined 60° with respect to the horizontal line parallel to the ground, and the upper inclined portion 41 is inclined 50° with respect to the horizontal line parallel to the ground.

As shown in (*b*), (*c*), and (*d*) of FIG. 32, the three-stage block 44 basically includes first to third three-stage blocks 44*a*, 44*b*, and 44*c* to which ten, eight, and five second light emitting diode modules 30 are respectively mounted. In the first three-stage block 44*a*, basically, two second light emitting diode modules 30 are mounted to the lower inclined portion 43, three second light emitting diode modules 30 are mounted to the middle inclined portion 42, and five second light emitting diode modules 30 are mounted to the upper inclined portion 41.

In the second three-stage block 44*b*, basically, two second light emitting diode modules 30 are mounted to the lower inclined portion 43, three second light emitting diode modules 30 are mounted to the middle inclined portion 42, and three second light emitting diode modules 30 are mounted to the upper inclined portion 41.

In the third three-stage block 44*c*, basically, two second light emitting diode modules 30 are mounted to the lower inclined portion 43, and three second light emitting diode modules 30 are mounted to the middle inclined portion 42.

As shown in (*a*) of FIG. 33, the inclined block member 40 includes an upper inclined portion 41 and a lower inclined portion 43 that are inclined at arbitrary angles with respect to a horizontal line that is parallel to the ground. That is, the inclined block member includes a two-stage block 45 of the lower inclined portion 43 and the upper inclined portion 41. In this case, the inclination angle of the lower inclined portion 43 is larger than that of the upper inclined portion 41.

In the invention, the lower inclined portion 43 is inclined 60° with respect to the horizontal line parallel to the ground, and the upper inclined portion 41 is inclined 50° with respect to the horizontal line parallel to the ground.

As shown in (*b*), (*c*), and (*d*) of FIG. 33, the two-stage block 44 basically includes first to third two-stage blocks 45*a*, 45*b*, and 45*c* to which ten, eight, and five second light emitting diode modules 30 are respectively mounted. In the first two-stage block 45*a*, basically, five second light emitting diode modules 30 are mounted to the lower inclined portion 43, and five second light emitting diode modules 30 are mounted to the upper inclined portion 41.

In the second two-stage block 45*b*, basically, five second light emitting diode modules 30 are mounted to the lower inclined portion 43, and three second light emitting diode modules 30 are mounted to the upper inclined portion 41.

In the third two-stage block 45*c*, basically, five second light emitting diode modules 30 are mounted to the lower inclined portion 43.

As shown in (*a*) of FIG. 34, the inclined block member 40 includes a single-stage block 46 having a single inclined portion that is inclined at an arbitrary angle with respect to a horizontal line that is parallel to the ground.

In the invention, as an example, the single inclined portion is inclined 60° with respect to the horizontal line parallel to the ground.

As shown in (*b*), (*c*), and (*d*) of FIG. 33, the single-stage block 46 basically includes first to third single-stage blocks 46*a*, 46*b*, and 46*c* to which ten, eight, and five second light emitting diode modules 30 are respectively mounted.

According to the following embodiments, it is possible to use the inclined block members 40 to illuminate the road in various light distribution types, that is, the first to fifth light distribution types.

Further, in the following embodiments, the side portion 12 of the lamp housing member 10 is divided into 18 parts for mounting the inclined block members 40. The 18 parts include first and second base mounting portions 70 and 71 opposite to each other, and pairs of first to eighth mounting portions 80, 81, 82, 83, 84, 85, 86, and 87 that are sequentially provided between the first base mounting portion 70 and the second base mounting portion 71 and are symmetric with respect to the center of a line linking the first and second base mounting portions 70 and 71. This structure of the lamp housing member 10 is common to the following embodiments.

The transparent panel member 13 may be mounted to the bottom of the lamp housing member 10, and the lamp housing member 10 may be provided with the heat sink 17 for dissipating heat. Since this structure has already been described in detail above, a detailed description thereof will be omitted in the following embodiments.

First Embodiment

Figure 35:
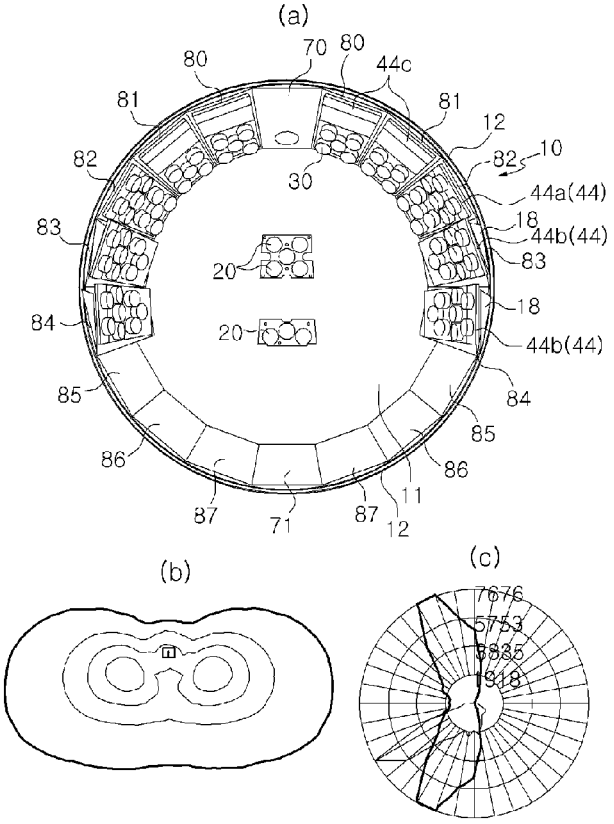
FIGS. 35 to 48 are diagrams illustrating other embodiments of the invention

In this embodiment, as shown in (*a*) of FIG. 35, first to third three-stage blocks 44*a*, 44*b*, and 44*c* respectively having 10, 8, and 5 second light emitting diode modules 30 mounted thereto are used. In the first three-stage block 44*a*, two second light emitting diode modules 30 each having a 25 diode lens are mounted to the lower inclined portion 43, three second light emitting diode modules 30 each having a 12° diode lens are mounted to the middle inclined portion 42, and three second light emitting diode modules 30, each having a 45° diode lens, and two second light emitting diode modules 30, each having a 30° diode lens, are mounted to the upper inclined portion 41. In the second three-stage block 44*b*, on the basis of the first three-stage block 44*a*, five second light emitting diode modules 30 are mounted to the lower inclined portion 43 and three second light emitting diode modules 30 are mounted to the upper inclined portion 41. In the third three-stage block 44*c*, five second light emitting diode modules 30 are mounted to the lower inclined portion 43.

Further, in this embodiment, eight first light emitting diode modules 20 are mounted to the lower surface of the upper plate 11, and combinations of the first to third three-stage blocks 44*a*, 44*b*, and 44*c* are mounted to the inner surface of the side portion 12. The third three-stage blocks 44*c* are mounted to the first and second mounting portions 80 and 81, the first three-stage blocks 44*a* are mounted to the third mounting portions 82, and the second three-stage blocks 44*b* are mounted to the fourth and fifth mounting portions 83 and 84.

Furthermore, 10° angle adjusting blocks 18 for adjusting both ends of each of the corresponding second three-stage blocks 44*b* are provided between the mounting surfaces of the fourth and fifth mounting portions 83 and 84 and the second three-stage blocks 44*b*. In the 10° angle adjusting block, one of the two ends facing the first base mounting portion 70 is raised such that the 10° angle adjusting block is inclined 10° toward the outside.

In this embodiment, as shown in (*b*) of FIG. 35, the second light distribution type is formed. As shown in (*c*) of FIG. 35, a maximum candela (cd) is 7660 cd, and the vertical angle of the maximum candela is 60°.

That is, this embodiment has a large maximum candela, and the largest vertical angle of the maximum candela, 60°, which is the largest value among other embodiments of the second light distribution type.

The large maximum candela and the large vertical angle of the maximum candela mean that the uniformity of the surface illuminated by a lamp is high. This embodiment has the highest uniformity among the other embodiments of the second light distribution type.

This embodiment can concentrate most of light on the road, which is an illumination target, and effectively illuminate only the road.

Second Embodiment

Figure 36:
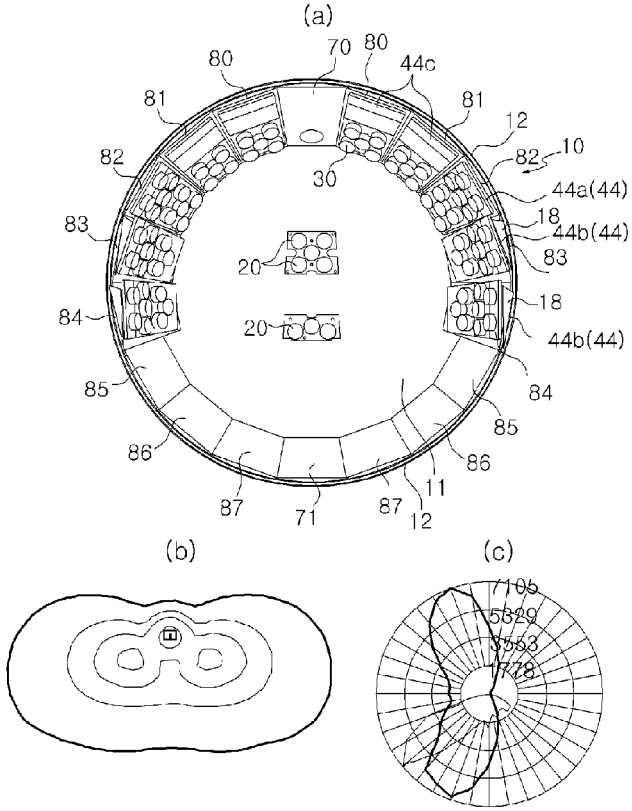

In this embodiment, as shown in (*a*) of FIG. 36, first to third three-stage blocks 44*a*, 44*b*, and 44*c* respectively having 10, 8, and 5 second light emitting diode modules 30 mounted thereto are used. In the first three-stage block 44*a*, two second light emitting diode modules 30 each having a 25° diode lens are mounted to the lower inclined portion 43, one second light emitting diode module 30 having a 25° diode lens and two second light emitting diode modules 30 each having a 30° diode lens are mounted to the middle inclined portion 42, and three second light emitting diode modules 30, each having a 45° diode lens, and two second light emitting diode modules 30, each having a 30° diode lens, are mounted to the upper inclined portion 41. In the second three-stage block 44*b*, on the basis of the first three-stage block 44*a*, five second light emitting diode modules 30 are mounted to the lower inclined portion 43 and three second light emitting diode modules 30 are mounted to the upper inclined portion 41. In the third three-stage block 44*c*, five second light emitting diode modules 30 are mounted to the lower inclined portion 43.

Further, in this embodiment, eight first light emitting diode modules 20 are mounted to the lower surface of the upper plate 11, and combinations of the first to third three-stage blocks 44*a*, 44*b*, and 44*c* are mounted to the inner surface of the side portion 12. The third three-stage blocks 44*c* are mounted to the first and second mounting portions 80 and 81, the first three-stage blocks 44*a* are mounted to the third mounting portions 82, and the second three-stage blocks 44*b* are mounted to the fourth and fifth mounting portions 83 and 84.

Furthermore, 10° angle adjusting blocks 18 for adjusting both ends of each of the corresponding second three-stage blocks 44*b* are provided between the mounting surfaces of the fourth and fifth mounting portions 83 and 84 and the second three-stage blocks 44*b*. In the 10° angle adjusting block, one of the two ends facing the first base mounting portion 70 is raised such that the 10° angle adjusting block is inclined 10° toward the outside.

In this embodiment, as shown in (*b*) of FIG. 36, the second light distribution type is formed. As shown in (*c*) of FIG. 36, a maximum candela (cd) is 7105 cd, and the vertical angle of the maximum candela is 50°.

That is, this embodiment has the average maximum candela and the average vertical angle of the maximum candela, 60°, of the other embodiments. Therefore, this embodiment can be used in the widest range.

Third Embodiment

Figure 37:
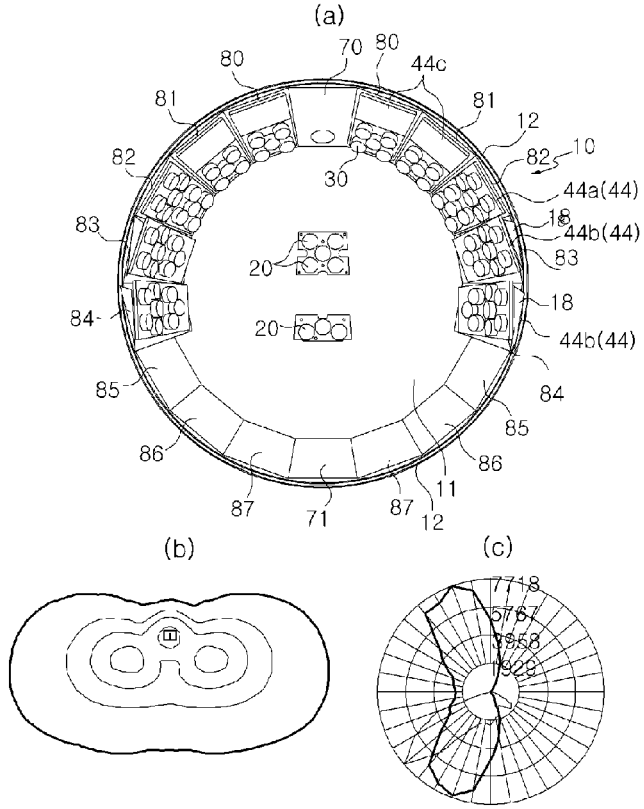

In this embodiment, as shown in (*a*) of FIG. 37, first to third two-stage blocks 45*a*, 45*b*, and 45*c* respectively having 10, 8, and 5 second light emitting diode modules 30 mounted thereto are used. In the first two-stage block 45*a*, two second light emitting diode modules 30, each having a 25° diode lens, and three second light emitting diode modules 30, each having a 45° diode lens, are mounted to the lower inclined portion 43, and three second light emitting diode modules 30, each having a 45° diode lens, and two second light emitting diode modules 30, each having a 30° diode lens, are mounted to the upper inclined portion 41. In the second two-stage block 45*b*, on the basis of the first two-stage block 45*a*, five second light emitting diode modules 30 are mounted to the lower inclined portion 43 and three second light emitting diode modules 30 are mounted to the upper inclined portion 41. In the third two-stage block 45*c*, five second light emitting diode modules 30 are mounted to the lower inclined portion 43.

Further, in this embodiment, eight first light emitting diode modules 20 are mounted to the lower surface of the upper plate 11, and combinations of the first to third two-stage blocks 45*a*, 45*b*, and 45*c* are mounted to the inner surface of the side portion 12. The third two-stage blocks 45*c* are mounted to the first and second mounting portions 80 and 81, the first two-stage blocks 45*a* are mounted to the third mounting portions 82, and the second two-stage blocks 45*b* are mounted to the fourth and fifth mounting portions 83 and 84.

Furthermore, 10° angle adjusting blocks 18 for adjusting both ends of each of the corresponding second two-stage blocks 45*b* are provided between the mounting surfaces of the fourth and fifth mounting portions 83 and 84 and the second two-stage blocks 45*b*. In the 10° angle adjusting block, one of the two ends facing the first base mounting portion 70 is raised such that the 10° angle adjusting block is inclined 10° toward the outside.

In this embodiment, as shown in (*b*) of FIG. 37, the second light distribution type is formed. As shown in (*c*) of FIG. 37, a maximum candela (cd) is 7716 cd, and the vertical angle of the maximum candela is 50°.

That is, this embodiment has the largest maximum candela and thus high uniformity.

Therefore, this embodiment can concentrate most of light on the road, which is an illumination target, and effectively illuminate only the road.

Fourth Embodiment

Figure 38:
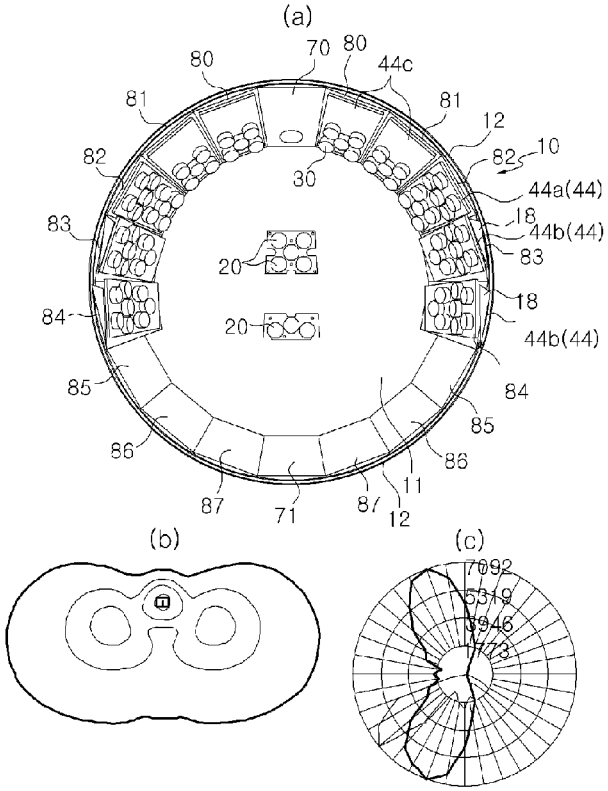

In this embodiment, as shown in (a) of FIG. 38, first to third single-stage blocks 46*a*, 46*b*, and 46*c* respectively having 10, 8, and 5 second light emitting diode modules 30 mounted thereto are used. In the first single-stage block 46*a*, two second light emitting diode modules 30, each having a 25° diode lens, are mounted to a lower portion, three second light emitting diode modules 30, each having a 30° diode lens, and three second light emitting diode modules 30, each having a 45° diode lens, are mounted to a middle portion, and two second light emitting diode modules 30, each having a 30° diode lens, are mounted to an upper portion. The second single-stage block 46*b* has eight second light emitting diode modules 30 mounted thereto, and the third single-stage block 46*c* has five second light emitting diode modules 30 mounted thereto, on the basis of the first single-stage block 46*a*.

Further, in this embodiment, eight first light emitting diode modules 20 are mounted to the lower surface of the upper plate 11, and combinations of the first to third single-stage blocks 46*a*, 46*b*, and 46*c* are mounted to the inner surface of the side portion 12. The third single-stage blocks 46*c* are mounted to the first and second mounting portions 80 and 81, the first single-stage blocks 46*a* are mounted to the third mounting portions 82, and the second single-stage blocks 46*b* are mounted to the fourth and fifth mounting portions 83 and 84.

Furthermore, 10° angle adjusting blocks 18 for adjusting both ends of each of the corresponding second single-stage blocks 46*b* are provided between the mounting surfaces of the fourth and fifth mounting portions 83 and 84 and the second single-stage blocks 46*b*. In the 10° angle adjusting block, one of the two ends facing the first base mounting portion 70 is raised such that the 10° angle adjusting block is inclined 10° toward the outside.

As shown in (*b*) of FIG. 38, this embodiment forms the second light distribution type. As shown in (*c*) of FIG. 38, a maximum candela (cd) is 7092 cd, and the vertical angle of the maximum candela is 50°.

That is, this embodiment has high productivity and assembility since it uses the single-stage blocks 46. In addition, since this embodiment has high thermal conductivity during operation, it is possible to stabilize the overall manufacturing process.

Further, this embodiment is advantageous to emit light immediately below the lamp housing member 10 that emits light below the lamp post 100.

Fifth Embodiment

Figure 39:
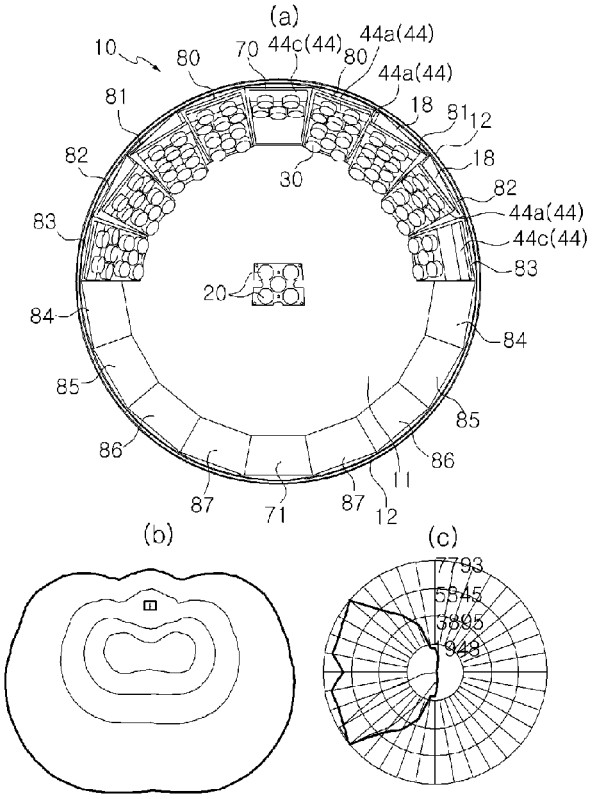

In this embodiment, as shown in (a) of FIG. 39, first and third three-stage blocks 44*a* and 44*c* respectively having 10 and 5 second light emitting diode modules 30 mounted thereto are used. In the first three-stage block 44*a*, two second light emitting diode modules 30 each having a 25° diode lens are mounted to the lower inclined portion 43, one second light emitting diode module 30 having a 25° diode lens and two second light emitting diode modules 30, each having a 30° diode lens, are mounted to the middle inclined portion 42, and three second light emitting diode modules 30, each having a 45° diode lens, and two second light emitting diode modules 30, each having a 30° diode lens, are mounted to the upper inclined portion 41. In the third three-stage block 44*c*, on the basis of the first three-stage block 44*a*, five second light emitting diode modules 30 are mounted to the lower inclined portion 43.

Further, in this embodiment, five first light emitting diode modules 20 are mounted to the lower surface of the upper plate 11, and combinations of the first and third three-stage blocks 44*a* and 44*c* are mounted to the inner surface of the side portion 12. The third three-stage block 44*c* is mounted to the first base mounting portion 70, the first three-stage blocks 44*a* are mounted to the first to third mounting portions 80 to 82, and the third three-stage blocks 44*b* are mounted to the fourth mounting portions 83.

Furthermore, 10° angle adjusting blocks 18 for adjusting both ends of each of the corresponding first three-stage blocks 44*a* are provided between the mounting surfaces of the second and third mounting portions 81 and 82 and the first three-stage blocks 44*a*. In the 10° angle adjusting block, one of the two ends facing the first base mounting portion 70 is raised such that the 10° angle adjusting block is inclined 10° toward the outside.

In this embodiment, as shown in (*b*) of FIG. 39, the third light distribution type is formed. As shown in (*c*) of FIG. 39, a maximum candela (cd) is 7793 cd, and the vertical angle of the maximum candela is 50°.

In this embodiment, light is not emitted to the rear side of the lamp housing member 10 where the second light emitting diode modules 30 are provided. Therefore, this embodiment is effective to illuminate only the road which a plurality of second light emitting diode modules 30 face.

Sixth Embodiment

Figure 40:
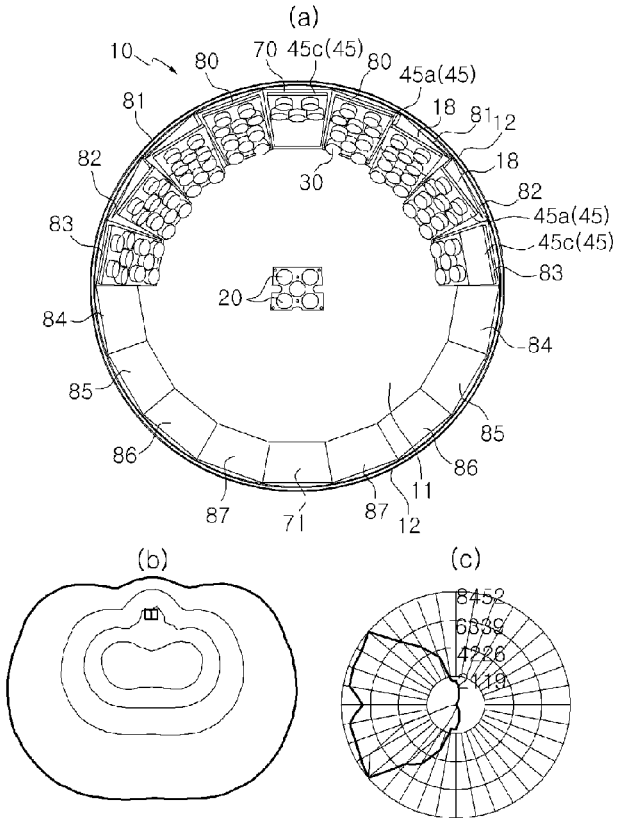

In this embodiment, as shown in (*a*) of FIG. 40, first and third two-stage blocks 45*a* and 45*c* respectively having 10 and 5 second light emitting diode modules 30 mounted thereto are used. In the first two-stage block 45*a*, two second light emitting diode modules 30, each having a 25° diode lens, and three second light emitting diode modules 30, each having a 30° diode lens, are mounted to the lower inclined portion 43, and three second light emitting diode modules 30, each having a 45° diode lens, and two second light emitting diode modules 30, each having a 30° diode lens, are mounted to the upper inclined portion 41. In the third two-stage block 45*c*, on the basis of the first two-stage block 45*a*, five second light emitting diode modules 30 are mounted to the lower inclined portion 43.

Further, in this embodiment, five first light emitting diode modules 20 are mounted to the lower surface of the upper plate 11, and combinations of the first and third two-stage blocks 45*a* and 45*c* are mounted to the inner surface of the side portion 12. The third two-stage block 45*c* is mounted to the first base mounting portion 70, the first two-stage blocks 45*a* are mounted to the first to third mounting portions 80 to 82, and the third two-stage block 45*c* is mounted to the fourth mounting portion 83.

Furthermore, 10° angle adjusting blocks 18 for adjusting both ends of each of the corresponding first two-stage blocks 45*a* are provided between the mounting surfaces of the second and third mounting portions 81 and 82 and the first two-stage blocks 45*a*. In the 10° angle adjusting block, one of the two ends facing the first base mounting portion 70 is raised such that the 10° angle adjusting block is inclined 10° toward the outside.

In this embodiment, as shown in (*b*) of FIG. 40, the third light distribution type is formed. As shown in (*c*) of FIG. 40, a maximum candela (cd) is 8452 cd, and the vertical angle of the maximum candela is 50°.

That is, since the maximum candela is the largest, this embodiment has high uniformity. In addition, light is not emitted to the rear side of the lamp housing member 10 where the second light emitting diode modules 30 are provided. Therefore, this embodiment is effective to illuminate only the road which a plurality of second light emitting diode modules 30 face.

Seventh Embodiment

Figure 41:
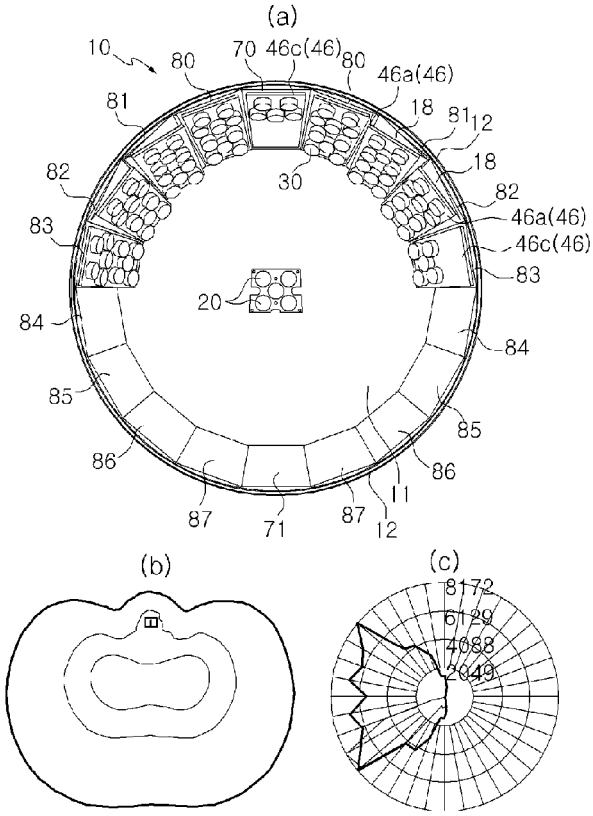

In this embodiment, as shown in (*a*) of FIG. 41, first and third single-stage blocks 46*a* and 46*c* respectively having 10 and 5 second light emitting diode modules 30 mounted thereto are used. In the first single-stage block 46*a*, two second light emitting diode modules 30, each having a 25° diode lens, are mounted to a lower portion, three second light emitting diode modules 30, each having a 30° diode lens, and three second light emitting diode modules 30, each having a 45° diode lens, are mounted to a middle portion, and two second light emitting diode modules 30, each having a 30° diode lens, are mounted to an upper portion. The third single-stage block 46*c* has five second light emitting diode modules 30 mounted thereto, on the basis of the first single-stage block 46*a*.

Further, in this embodiment, five first light emitting diode modules 20 are mounted to the lower surface of the upper plate 11, and combinations of the first and third single-stage blocks 46*a* and 46*c* are mounted to the inner surface of the side portion 12. The third single-stage block 46*c* is mounted to the first base mounting portion 70, the first single-stage blocks 46*a* are mounted to the first to third mounting portions 80 to 82, and the third single-stage block 46*b* is mounted to the fourth mounting portion 83.

Furthermore, 10° angle adjusting blocks 18 for adjusting both ends of each of the corresponding first single-stage blocks 46*a* are provided between the mounting surfaces of the second and third mounting portions 81 and 82 and the first single-stage blocks 46*a*. In the 10° angle adjusting block, one of the two ends facing the first base mounting portion 70 is raised such that the 10° angle adjusting block is inclined 10° toward the outside.

As shown in (*b*) of FIG. 41, this embodiment forms the third light distribution type. As shown in (*c*) of FIG. 41, a maximum candela (cd) is 8172 cd, and the vertical angle of the maximum candela is 60°.

This embodiment has a large maximum candela and the largest vertical angle of the maximum candela, 60°, which is the largest value among the other embodiments of the third light distribution type.

The large maximum candela and the large vertical angle of the maximum candela mean that the uniformity of the surface illuminated by a lamp is high. This embodiment has the highest uniformity among the other embodiments of the third light distribution type.

This embodiment can concentrate most of light on the road, which is an illumination target, and effectively illuminate only the road.

Further, this embodiment has high productivity and assembility since it uses the single-stage blocks 46. In addition, since this embodiment has high thermal conductivity during operation, it is possible to stabilize the overall manufacturing process.

Furthermore, in this embodiment, light is not emitted to the rear side of the lamp housing member 10 where the second light emitting diode modules 30 are provided. Therefore, this embodiment is effective to illuminate only the road to which a plurality of second light emitting diode modules 30 face.

Eighth Embodiment

Figure 42:
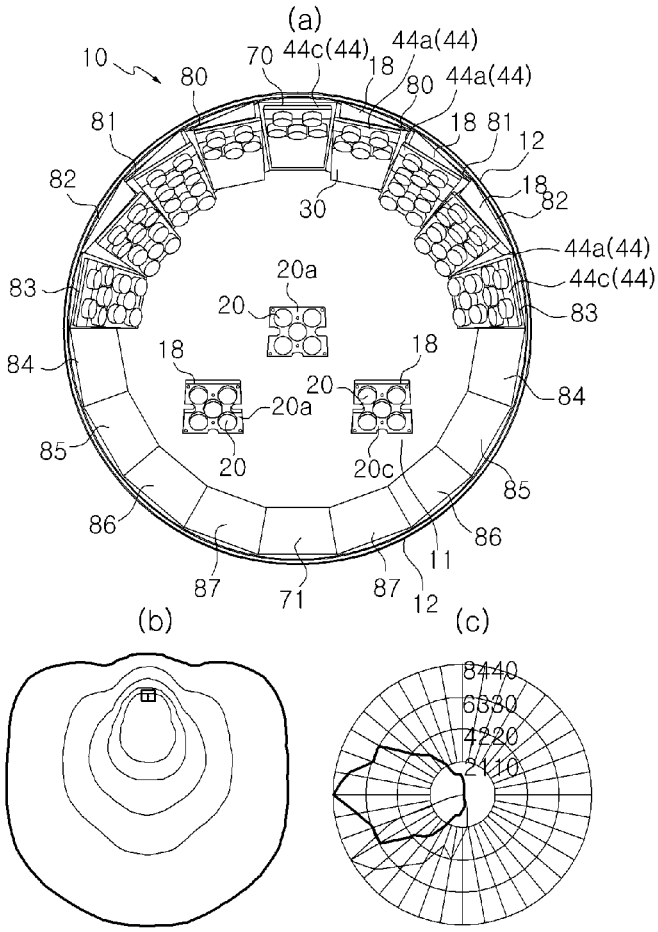

In this embodiment, as shown in (*a*) of FIG. 42, first and third three-stage blocks 44*a* and 44*c* respectively having 10 and 5 second light emitting diode modules 30 mounted thereto are used. In the first three-stage block 44*a*, two second light emitting diode modules 30 each having a 25° diode lens are mounted to the lower inclined portion 43, one second light emitting diode module 30 having a 25° diode lens and two second light emitting diode modules 30, each having a 30° diode lens, are mounted to the middle inclined portion 42, and three second light emitting diode modules 30, each having a 45° diode lens, and two second light emitting diode modules 30, each having a 30° diode lens, are mounted to the upper inclined portion 41. In the third three-stage block 44*c*, on the basis of the first three-stage block 44*a*, five second light emitting diode modules 30 are mounted to the lower inclined portion 43.

Further, in this embodiment, first to third upper light emitting diode units 20*a*, 20*b*, and 20*c* each having five first light emitting diode modules 20 are provided on the lower surface of the upper plate 11.

The first upper light emitting diode unit 20*a* is provided at the center of the lower surface of the upper plate 11, and the second and third upper light emitting diode units 20*b* are 20*c* are provided on the lower surface at both sides of a line linking the first and second base mounting portions 70 and 71, with 20° angle adjusting blocks 18 interposed between the mounting surfaces, such that they are inclined 20° toward the road to be illustrated.

Furthermore, in this embodiment, combinations of the first and third three-stage blocks 44*a* and 44*c* are mounted to the inner surface of the side portion 12. The third three-stage blocks 44*c* are mounted to the first base mounting portion 70 and the first mounting portion 80, the first three-stage blocks 44*a* are mounted to the second and third mounting portions 81 and 82, and the third three-stage blocks 44*c* are mounted to the fourth mounting portions 83.

Furthermore, 10° angle adjusting blocks 18 for adjusting both ends of each of the corresponding third and first three-stage blocks 44*c* and 44*a* are provided between the mounting surfaces of the first and second mounting portions 80 and 81 and the third and first three-stage blocks 44*c* and 44*a*. In the 10° angle adjusting block, one of the two ends facing the first base mounting portion 70 is raised such that the 10° angle adjusting block is inclined 10° toward the outside. In addition, 20° angle adjusting blocks 18 for adjusting both ends of each of the corresponding third three-stage blocks 44*c* are provided between the mounting surfaces of the third mounting portions 82 and the third three-stage blocks 44*c*. In the 20° angle adjusting block, one of the two ends facing the first base mounting portion 70 is raised such that the 20° angle adjusting block is inclined 20° toward the outside.

As shown in (*b*) of FIG. 42, this embodiment forms the fourth light distribution type. As shown in (*c*) of FIG. 42, a maximum candela (cd) is 8440 cd, and the vertical angle of the maximum candela is 60°.

This embodiment of the fourth light distribution type has a large maximum candela and a large vertical angle, 60°, of the maximum candela. Therefore, this embodiment has high uniformity.

In this embodiment, the maximum candela is obtained in the vicinity of the lamp housing member 10, and the quantity of light is concentrated below the lamp post 100. Therefore, this embodiment is effective to focus light on a small area with high brightness.

Ninth Embodiment

Figure 43:
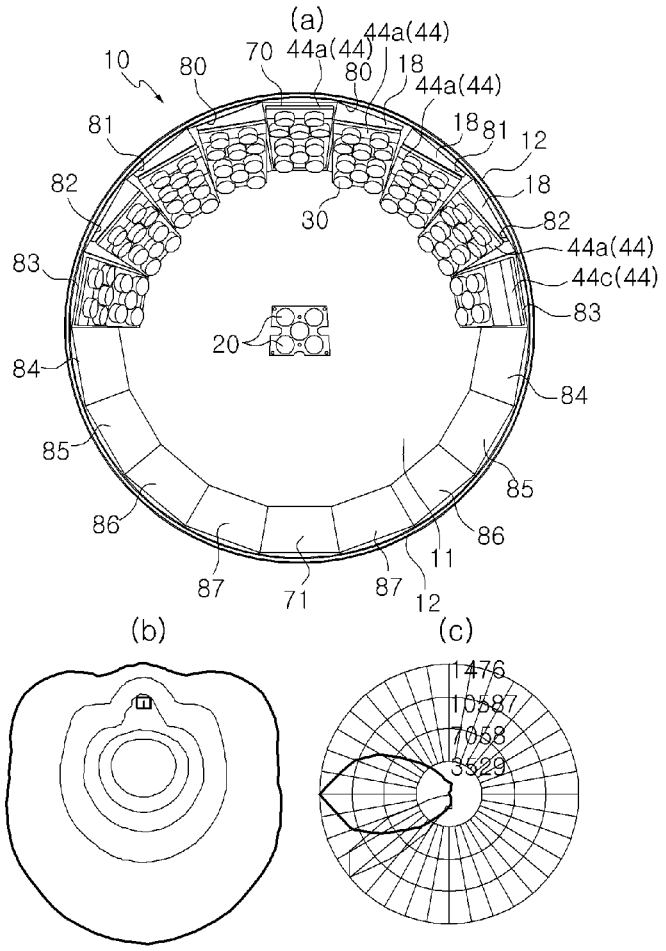

In this embodiment, as shown in (*a*) of FIG. 43, first and third three-stage blocks 44*a* and 44*c* respectively having 10 and 5 second light emitting diode modules 30 mounted thereto are used. In the first three-stage block 44*a*, two second light emitting diode modules 30 each having a 25° diode lens are mounted to the lower inclined portion 43, one second light emitting diode module 30 having a 25° diode lens and two second light emitting diode modules 30, each having a 30° diode lens, are mounted to the middle inclined portion 42, and three second light emitting diode modules 30, each having a 45° diode lens, and two second light emitting diode modules 30, each having a 30° diode lens, are mounted to the upper inclined portion 41. In the third three-stage block 44*c*, on the basis of the first three-stage block 44*a*, five second light emitting diode modules 30 are mounted to the lower inclined portion 43.

Further, in this embodiment, five first light emitting diode modules 20 are mounted at the center of the lower surface of the upper plate 11, and combinations of the first and third three-stage blocks 44*a* and 44*c* are mounted to the inner surface of the side portion 12. The first three-stage blocks 44*a* are mounted to the first base mounting portion 70 and the first to third mounting portions 80 to 82, and the third three-stage blocks 44*c* are mounted to the fourth mounting portions 83.

Furthermore, 20° angle adjusting blocks 18 for adjusting both ends of each of the corresponding first three-stage blocks 44*a* are provided between the mounting surfaces of the first to third mounting portions 80 to 82 and the first three-stage blocks 44*a*. In the 20° angle adjusting block, one of the two ends facing the first base mounting portion 70 is raised such that the 20° angle adjusting block is inclined 20° toward the outside.

In this embodiment, as shown in (*b*) of FIG. 43, the fourth light distribution type is formed. As shown in (*c*) of FIG. 43, a maximum candela (cd) is 14176 cd, and the vertical angle of the maximum candela is 50°.

This embodiment has the largest maximum candela among the other embodiments of the fourth light distribution type and thus has high uniformity. The maximum candela is obtained at a distance from the lamp housing member 10. Therefore, this embodiment is effective to illuminate a large area and can obtain uniform light distribution.

Tenth Embodiment

Figure 44:
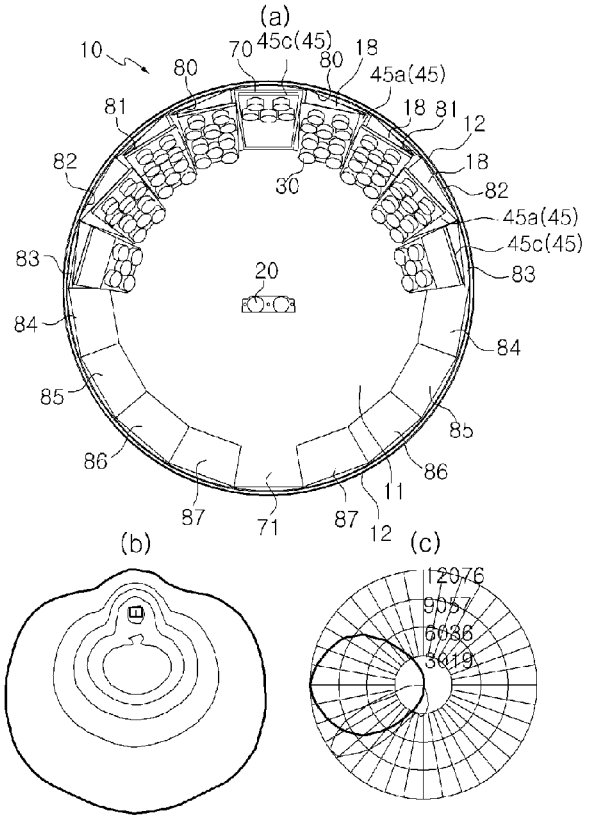

In this embodiment, as shown in (*a*) of FIG. 44, first and third two-stage blocks 45*a* and 45*c* respectively having 10 and 5 second light emitting diode modules 30 mounted thereto are used. In the first two-stage block 45*a*, two second light emitting diode modules 30, each having a 25° diode lens, and three second light emitting diode modules 30, each having a 30° diode lens, are mounted to the lower inclined portion 43, and three second light emitting diode modules 30, each having a 45° diode lens, and two second light emitting diode modules 30, each having a 30° diode lens, are mounted to the upper inclined portion 41. In the third two-stage block 45*c*, on the basis of the first two-stage block 45*a*, five second light emitting diode modules 30 are mounted to the lower inclined portion 43.

Further, in this embodiment, two first light emitting diode modules 20 are mounted at the center of the lower surface of the upper plate 11, and combinations of the first and third two-stage blocks 45*a* and 45*c* are mounted to the inner surface of the side portion 12. The first two-stage blocks 45*a* are mounted to the first base mounting portion 70 and the first to third mounting portions 80 to 82, and the third two-stage blocks 45*c* are mounted to the fourth mounting portions 83.

Further, 10° angle adjusting blocks 18 are provided between the mounting surfaces of the first, second, and fourth mounting portions 80, 81, and 83 and the first and third two-stage blocks 45*a* and 45*c* corresponding thereto, thereby adjusting both ends of each of the first and third two-stage blocks. In the 10° angle adjusting block, one of the two ends facing the first base mounting portion 70 is raised such that the 10° angle adjusting block is inclined 10° toward the outside. In addition, 20° angle adjusting blocks 18 for adjusting both ends of each of the corresponding first two-stage blocks 45*a* are provided between the mounting surfaces of the third mounting portions 82 and the first two-stage blocks 45*a*. In the 20° angle adjusting block, one of the two ends facing the first base mounting portion 70 is raised such that the 20° angle adjusting block is inclined 20° toward the outside.

In this embodiment, as shown in (*b*) of FIG. 44, the fourth light distribution type is formed. As shown in (*c*) of FIG. 44, a maximum candela (cd) is 12076 cd, and the vertical angle of the maximum candela is 50°.

This embodiment has a large maximum candela among the other embodiments of the fourth light distribution type and thus has high uniformity. The maximum candela is obtained at a distance from the lamp housing member 10. Therefore, this embodiment is effective to illuminate a large area and can obtain uniform light distribution.

Eleventh Embodiment

Figure 45:
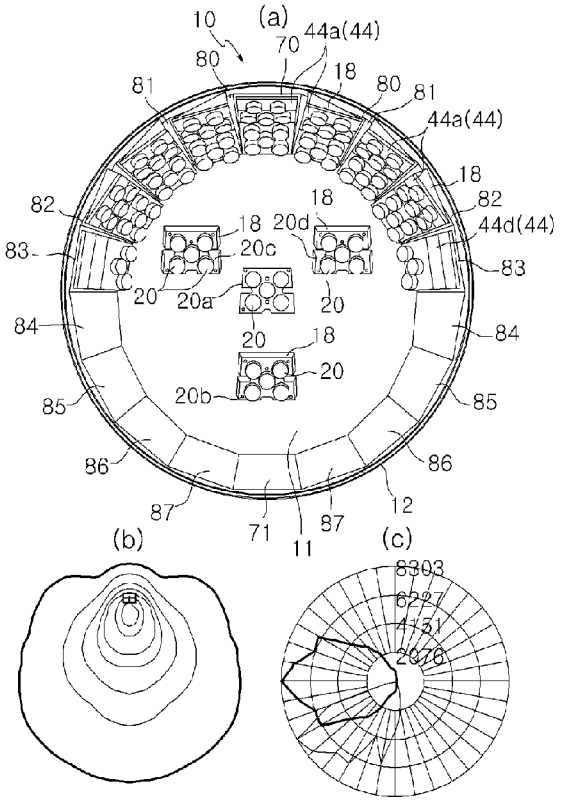

In this embodiment, as shown in (*a*) of FIG. 45, first and fourth three-stage blocks 44*a* and 44*d* respectively having 10 and 3 second light emitting diode modules 30 mounted thereto are used. In the first three-stage block 44*a*, two second light emitting diode modules 30 each having a 25° diode lens are mounted to the lower inclined portion 43, one second light emitting diode module 30 having a 25° diode lens and two second light emitting diode modules 30, each having a 30° diode lens, are mounted to the middle inclined portion 42, and three second light emitting diode modules 30, each having a 45° diode lens, and two second light emitting diode modules 30, each having a 30° diode lens, are mounted to the upper inclined portion 41. In the fourth three-stage block 44*d*, three second light emitting diode modules 30, each having a 30° diode lens, are mounted to the upper inclined portion 41.

Further, in this embodiment, first to fourth upper light emitting diode units 20*a*, 20*b*, 20*c*, and 20*d* each having five first light emitting diode modules 20 are provided on the lower surface of the upper plate 11.

The first upper light emitting diode unit 20*a* is provided at the center of the lower surface of the upper plate 11, the second upper light emitting diode unit 20*b* is provided between the first upper light emitting diode unit 20*a* and the second base mounting portion 71, and the third and fourth upper light emitting diode units 20*c* are 20*d* are provided on the lower surface at both sides of a line linking the first and second base mounting portions 70 and 71, with 20° angle adjusting blocks 18 interposed between the mounting surfaces, such that they are inclined 20° toward the road to be illustrated.

Furthermore, in this embodiment, combinations of the first and fourth three-stage blocks 44*a* and 44*d* are mounted to the inner surface of the side portion 12. The first three-stage blocks 44*a* are mounted to the first base mounting portion 70 and the first to third mounting portions 80 to 82, and the fourth three-stage blocks 44*d* are mounted to the fourth mounting portions 83.

Further, 10° angle adjusting blocks 18 are provided between the mounting surfaces of the first to third mounting portions 80, 81, and 82 and the first three-stage blocks 44*a* corresponding thereto, thereby adjusting both ends of each of the first three-stage blocks. In the 10° angle adjusting block, one of the two ends facing the first base mounting portion 70 is raised such that the 10° angle adjusting block is inclined 10° toward the outside.

In this embodiment, as shown in (*b*) of FIG. 45, the fourth light distribution type is formed. As shown in (*c*) of FIG. 45, a maximum candela (cd) is 8303 cd, and the vertical angle of the maximum candela is 60°.

This embodiment has a large maximum candela and a large vertical angle of the maximum candela among the other embodiments of the fourth light distribution type and thus has high uniformity. The maximum candela is obtained in the vicinity of the lamp housing member 10 and the quantity of light is concentrated below the lamp post 100. Therefore, this embodiment is effective to focus light on a small area with high brightness.

Twelfth Embodiment

Figure 46:
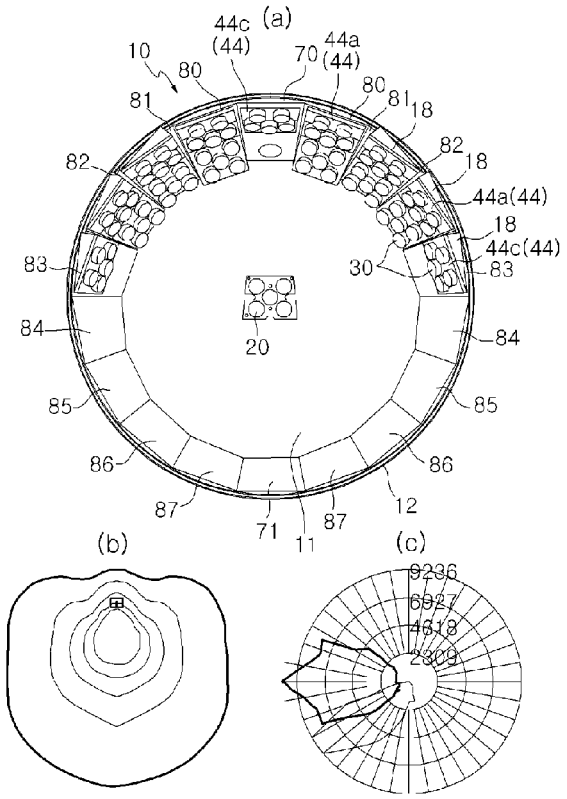

In this embodiment, as shown in (*a*) of FIG. 46, first and third three-stage blocks 44*a* and 44*c* respectively having 10 and 5 second light emitting diode modules 30 mounted thereto are used. In the first three-stage block 44*a*, two second light emitting diode modules 30 each having a 25° diode lens are mounted to the lower inclined portion 43, one second light emitting diode module 30 having a 25° diode lens and two second light emitting diode modules 30, each having a 30° diode lens, are mounted to the middle inclined portion 42, and three second light emitting diode modules 30, each having a 45° diode lens, and two second light emitting diode modules 30, each having a 30° diode lens, are mounted to the upper inclined portion 41. In the third three-stage block 44*c*, on the basis of the first three-stage block 44*a*, five second light emitting diode modules 30 are mounted to the lower inclined portion 43.

Further, in this embodiment, five first light emitting diode modules 20 are mounted at the center of the lower surface of the upper plate 11, and combinations of the first and third three-stage blocks 44*a* and 44*c* are mounted to the inner surface of the side portion 12. The third three-stage blocks 44*c* are mounted to the first base mounting portion 70 and the fourth mounting portions 83, and the first three-stage blocks 44*a* are mounted to the first to third mounting portions 80 to 82.

Further, 10° angle adjusting blocks 18 are provided between the mounting surfaces of the first, second, and fourth mounting portions 80, 81, and 83 and the first and third three-stage blocks 44*a* and 44*c* corresponding thereto, thereby adjusting both ends of each of the first and third three-stage blocks. In the 10° angle adjusting block, one of the two ends facing the first base mounting portion 70 is raised such that the 10° angle adjusting block is inclined 10° toward the outside.

In addition, 30° angle adjusting blocks 18 are provided between the mounting surfaces of the first mounting portions 80 and the first three-stage blocks 44*a*, thereby adjusting the angles of the first three-stage blocks in the vertical direction. The 30° angle adjusting block raises one end of the upper inclined portion 41 such that the first three-stage block is further inclined by 30°.

In this embodiment, as shown in (*b*) of FIG. 46, the fourth light distribution type is formed. As shown in (*c*) of FIG. 46, a maximum candela (cd) is 9236 cd, and the vertical angle of the maximum candela is 60°.

That is, this embodiment has the largest maximum candela and thus high uniformity. Therefore, this embodiment can concentrate light below the lamp housing member 10 and thus is effective to illuminate a small area with high brightness.

Thirteenth Embodiment

Figure 47:
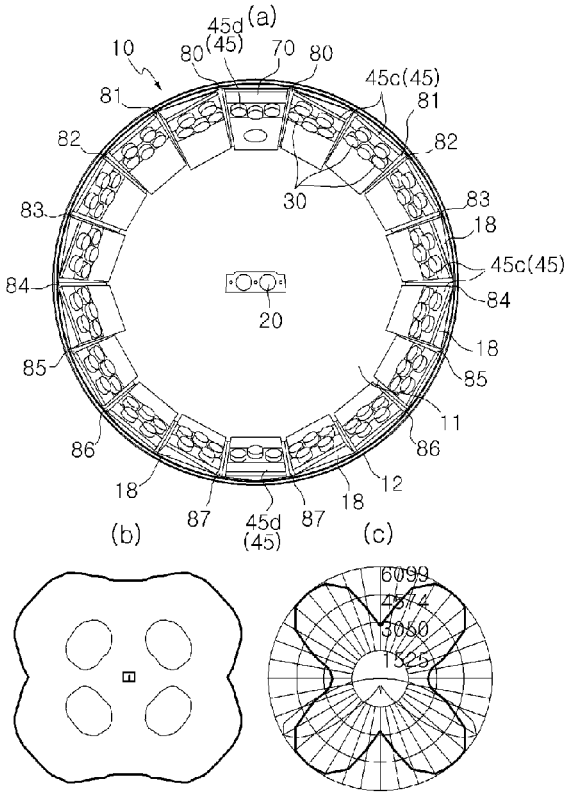

In this embodiment, as shown in (*a*) of FIG. 47, third and fourth two-stage blocks 45*c* and 45*d* respectively having 5 and 3 second light emitting diode modules 30 mounted thereto are used. In the third two-stage block 45*c*, two second light emitting diode modules 30, each having a 25° diode lens, and three second light emitting diode modules 30, each having a 30° diode lens, are mounted to the lower inclined portion 43. In the fourth two-stage block 45*d*, three second light emitting diode modules 30, each having a 30° diode lens, are mounted to the lower inclined portion 43.

Further, in this embodiment, two first light emitting diode modules 20 are mounted at the center of the lower surface of the upper plate 11, and combinations of the third and fourth three-stage blocks 44*c* and 44*d* are mounted to the inner surface of the side portion 12. The fourth three-stage blocks 44*d* are mounted to the first and second base mounting portions 70 and 71, and the third three-stage blocks 44*c* are mounted to the first to eighth mounting portions 80 to 87.

Further, 10° angle adjusting blocks 18 are provided between the mounting surfaces of the first and eighth mounting portions 80 and 87 and the third three-stage blocks 44*c* corresponding thereto, thereby adjusting both ends of each of the third three-stage blocks 44*c*. In this way, a pair of third three-stage blocks 44*c* mounted on the first mounting portions 80 are inclined 10° so as to face each other, and a pair of third three-stage blocks 44*c* mounted on the eighth mounting portions 87 are inclined 10° so as to face each other.

Furthermore, 10° angle adjusting blocks 18 are provided between the mounting surfaces of the fourth and fifth mounting portions 83 and 84 and the third three-stage blocks 44*c* corresponding thereto, thereby adjusting both ends of each of the third three-stage blocks 44*c*. In this way, the third three-stage blocks 44*c* mounted on the fourth and fifth mounting portion 83 and 84 are inclined 10° so as to face each other.

In this embodiment, as shown in (*b*) of FIG. 47, the fifth light distribution type is formed. As shown in (*c*) of FIG. 47, a maximum candela (cd) is 6099 cd, and the vertical angle of the maximum candela is 60°.

This embodiment of the fifth light distribution type has a large maximum candela and a large vertical angle of the maximum candela, and thus has high uniformity. Therefore, this embodiment is effective to emit light below the lamp housing member 10 at various angles, thereby illuminating a wide area.

Fourteenth Embodiment

Figure 48:
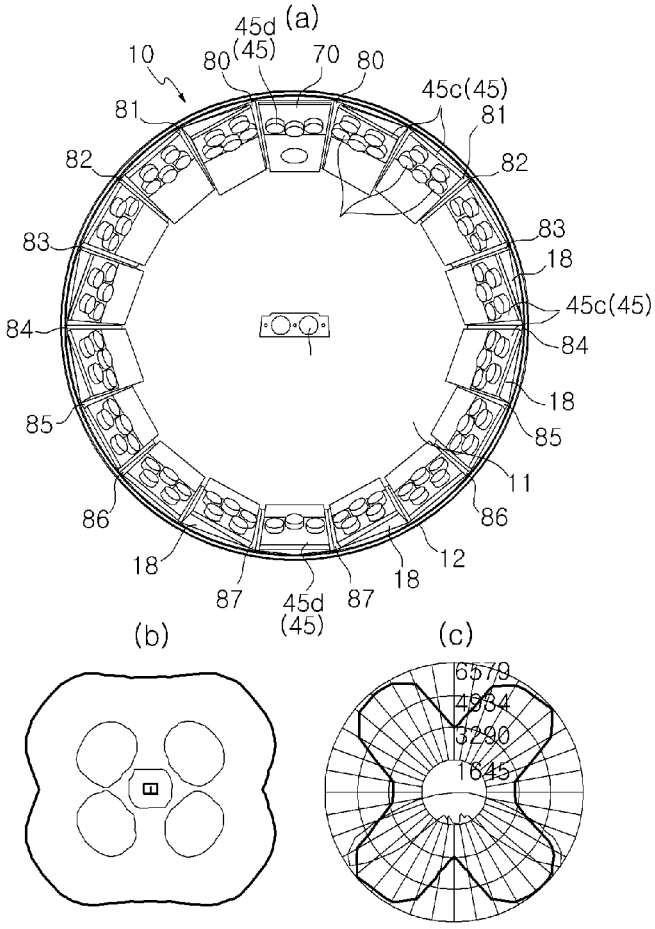

In this embodiment, as shown in (*a*) of FIG. 48, third and fourth two-stage blocks 45*c* and 45*d* respectively having 5 and 3 second light emitting diode modules 30 mounted thereto are used. In the third two-stage block 45*c*, two second light emitting diode modules 30, each having a 25° diode lens, and three second light emitting diode modules 30, each having a 30° diode lens, are mounted to the lower inclined portion 43. In the fourth two-stage block 45*d*, three second light emitting diode modules 30, each having a 30° diode lens, are mounted to the lower inclined portion 43.

Further, in this embodiment, two first light emitting diode modules 20 are mounted at the center of the lower surface of the upper plate 11, and combinations of the third and fourth three-stage blocks 44*c* and 44*d* are mounted to the inner surface of the side portion 12. The fourth three-stage blocks 44*d* are mounted to the first and second base mounting portions 70 and 71, and the third three-stage blocks 44*c* are mounted to the first to eighth mounting portions 80 to 87.

Further, 10° angle adjusting blocks 18 are provided between the mounting surfaces of the first and eighth mounting portions 80 and 87 and the third three-stage blocks 44*c* corresponding thereto, thereby adjusting both ends of each of the third three-stage blocks 44*c*. In this way, a pair of third two-stage blocks 45*c* mounted on the first mounting portions 80 are inclined 10° so as to face each other, and a pair of third three-stage blocks 44*c* mounted on the eighth mounting portions 88 are inclined 10° so as to face each other.

Furthermore, 10° angle adjusting blocks 18 are provided between the mounting surfaces of the fourth and fifth mounting portions 83 and 84 and the third two-stage blocks 45*c* corresponding thereto, thereby adjusting both ends of each of the third two-stage blocks 45*c*. In this way, the third two-stage blocks 45*c* mounted on the fourth and fifth mounting portion 83 and 84 are inclined 10° so as to face each other.

In this embodiment, as shown in (*b*) of FIG. 48, the fifth light distribution type is formed. As shown in (*c*) of FIG. 48, a maximum candela (cd) is 6579 cd, and the vertical angle of the maximum candela is 60°.

This embodiment of the fifth light distribution type has a large maximum candela and a large vertical angle of the maximum candela, and thus has high uniformity. Therefore, this embodiment is effective to emit light below the lamp housing member 10 at various angles, thereby illuminating a wide area.

As described above, according to the invention, it is possible to easily obtain various light distributions required for the lighting design by arbitrarily adjusting the mounting angles and the number of second light emitting diode modules 30 mounted to the side portion 12 of the lamp housing member 10. As a result, it is possible to improve flexibility in the road lighting design.

Although the exemplary embodiments of the invention have been described above, the invention is not limited thereto, and various modifications and changes of the invention can be made without departing from the scope and spirit of the invention.

Further, basically, the invention is used for streetlamps, and can also be used to form various light distributions.

The invention claimed is:

1. A lighting apparatus using light emitting diodes, comprising:

a lamp housing member that has a circular upper plate and a side portion formed at an outer circumference of the upper plate;

light emitting diode modules that are provided on an inner surface of the side portion; and a plurality of angle adjusting blocks, wherein the plurality of the angle adjusting blocks are inserted between the light emitting diode modules and the inner surface of the side portion, wherein the plurality of the angle adjusting blocks are mounted detachably to the inner surface of the side portion and respectively have inclined planes so as to adjust mounting angles of the light emitting diode modules in lateral and vertical directions, wherein the plurality of the angle adjusting blocks include three-stage blocks each having an upper inclined portion, a middle inclined portion, and a lower inclined portion that are inclined at different angles or two-stage blocks each having an upper inclined portion and a lower inclined portion that are inclined at different angles, wherein the angle adjusting blocks are mounted on the inner surface of the side portion of the lamp housing member at intervals in a state where at least one light emitting diode module is mounted on the inclined plane, wherein some of the plural angle adjusting blocks that are mounted on the inner surface of the side portion of the lamp housing member are different from each other in the number of the light emitting diode modules and in the mounting angles of the light emitting diode modules, and wherein the angle adjusting blocks that have the same number of the light emitting diode modules and the same mounting angle are symmetrically formed on a reference line passing through the center of the lamp housing member at a point where the lamp housing member is mounted to an arm member of the lamp post.

2. The lighting apparatus of claim 1, wherein the upper plate is formed so as to be inclined with respect to a horizontal plane.

3. The lighting apparatus of claim 1, wherein the side portion includes a plurality of inclined planes having different inclination angles.

4. The lighting apparatus of claim 1, wherein a transparent panel member for covering an opening portion is mounted to the side portion of the lamp housing member.

5. The lighting apparatus of claim 1, wherein a heat sink for dissipating heat is provided at an upper part of the lamp housing member.

6. The lighting apparatus of claim 5, wherein a drain outlet capable of draining water is formed in the heat sink.

7. The lighting apparatus of claim 1, wherein, in the three-stage block, the lower inclined portion has the largest inclination angle with respect to a horizontal line that is parallel to the ground, followed by the middle inclined portion and the upper inclined portion.

8. The lighting apparatus of claim 1, wherein, in the two-stage block, the inclination angle of the upper inclined portion with respect to the horizontal line parallel to the ground is smaller than that of the lower inclined portion.

9. The lighting apparatus of claim 1, further comprising at least one light emitting diode module that is provided on a lower surface of the upper plate.

* * * * *